United States Patent [19]

Ferguson et al.

[11] 4,097,976

[45] Jul. 4, 1978

[54] SPINNING TUBE STRIPPING MEANS

[75] Inventors: Richard Ferguson; Gettys D. Hoyle, Jr., both of Charlotte, N.C.

[73] Assignee: The Terrell Machine Company, Charlotte, N.C.

[21] Appl. No.: 698,908

[22] Filed: Jun. 23, 1976

[51] Int. Cl.[2] ..... B65H 73/00

[52] U.S. Cl. ..... 28/297

[58] Field of Search ..... 28/20, 297

[56] References Cited

U.S. PATENT DOCUMENTS

| | | | |
|---|---|---|---|
| 869,856 | 10/1907 | Leathers | 28/20 |
| 1,110,988 | 9/1914 | Holt | 28/20 |
| 1,426,303 | 8/1922 | Lonzo | 28/20 |
| 2,009,709 | 7/1935 | Terrell | 28/20 |
| 2,036,405 | 4/1936 | Gale | 28/20 |
| 2,907,091 | 10/1959 | Ferguson | 28/20 |

FOREIGN PATENT DOCUMENTS

| | | | |
|---|---|---|---|
| 957,647 | 2/1957 | Fed. Rep. of Germany | 28/297 |
| 348,378 | 9/1960 | Switzerland | 28/297 |
| 140,756 | 3/1961 | U.S.S.R. | 28/297 |

*Primary Examiner*—Robert R. Mackey

*Attorney, Agent, or Firm*—Richards, Shefte & Pinckney

[57] ABSTRACT

Means for stripping residual yarn from spent spinning tubes effectively, and while protecting the physical condition of the spinning tubes as they are handled for stripping, is provided by combining means for aligning a spinning tube axially for stripping with means for applying a pair of stripping blades oppositely and transversely to the body of an aligned spinning tube adjacent the base thereof, and means acting at the tip of an aligned spinning tube for pressing the same axially between the applied stripping blades, while additionally arranging means for relieving the stripping blade application whenever the pressing means is resisted by a stripping force sufficient to threaten spinning tube damage.

14 Claims, 35 Drawing Figures

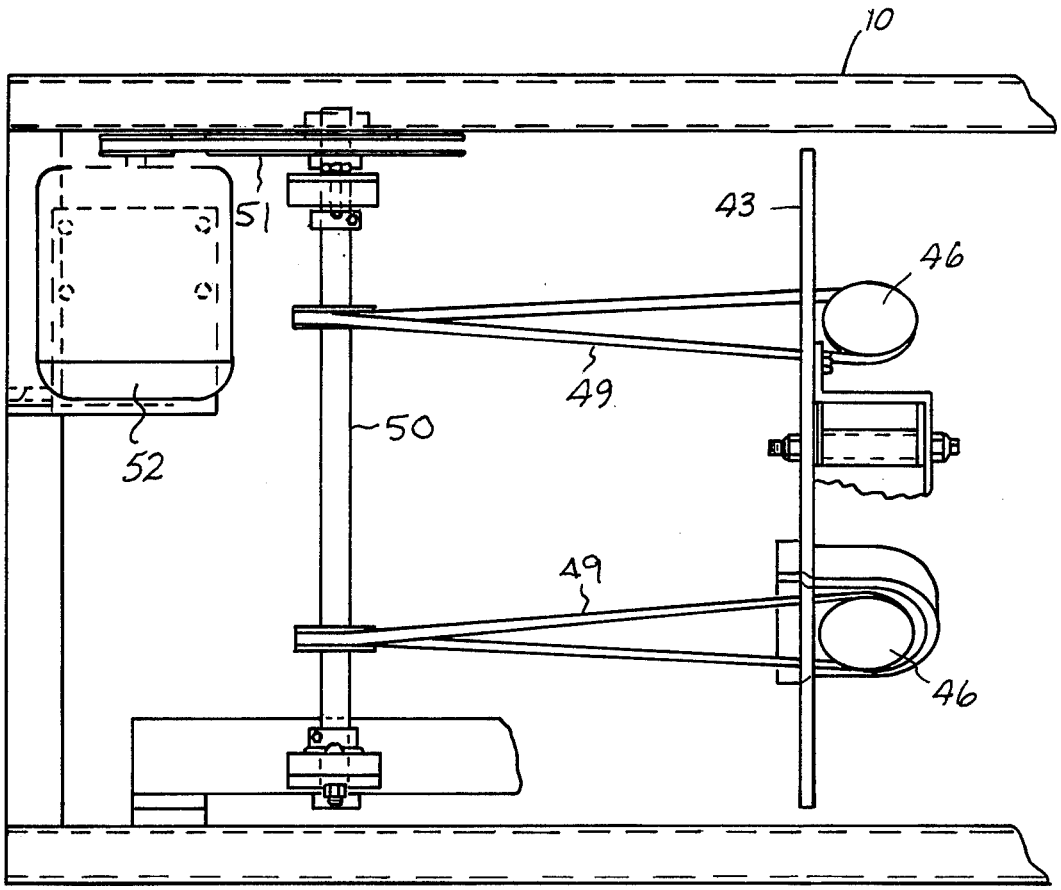
Fig 12
Fig. 11
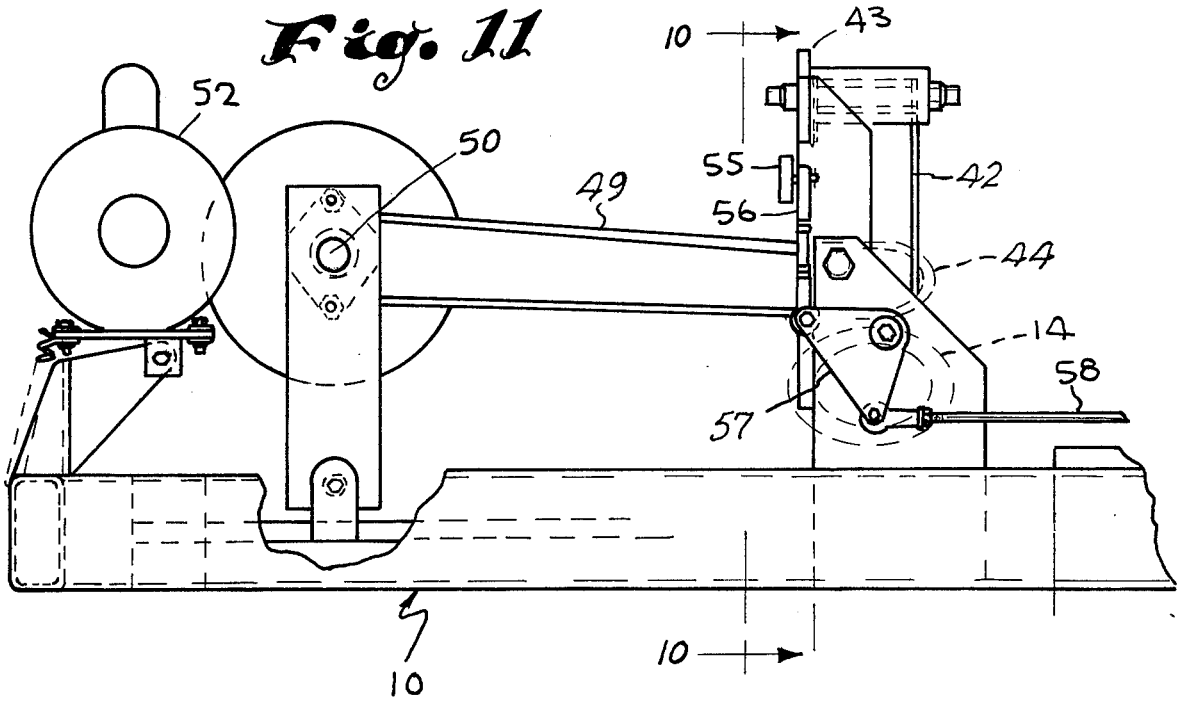

SPINNING TUBE STRIPPING MEANS

BACKGROUND OF THE INVENTION

In textile operations that involve off-winding of yarn packages from spinning tubes, the spent spinning tubes ejected from the operation characteristically have residual yarn remaining thereon adjacent the spinning tube base which must be removed or stripped before the spinning tubes can be reused. U.S. Pat. No. 3,803,673 is a recent example of means heretofore proposed for accomplishing such removal or stripping. It is important that the residual yarn stripping be done without material scuffing of the spinning tube barrel or otherwise damaging the tube structure so as to recover the stripped tubes consistently in satisfactory form for reuse.

The present invention provides stripping means arranged for removing the residual yarn in a particularly effective manner, while at the same time materially reducing the possibility of barrel scuffing and otherwise guarding against physically damaging the spinning tubes as they are handled for stripping.

SUMMARY OF THE INVENTION

Briefly characterized, the stripping means of the present invention is arranged to align a spinning tube axially for stripping from a chute supply of spent tubes, to apply a pair of stripping blades lightly to the aligned spinning tube adjacent its base, to press the aligned tube at its tip end axially between the stripping blades under circumstances that cause these blades upon reaching the residual waste to grip thereat with greater force for stripping, but relieve such gripping through self-adjustment whenever axial pressing of the tubes is resisted by a stripping force sufficient to threaten spinning tube damage.

In addition, the stripping means is also arranged to detect improper separation of a spinning tube from the supply chute for alignment with the stripping blades, and upon such detection to disable the aligning means until the detected improper separation is corrected.

It is also notable that the stripping means provided can be arranged for handling spent spinning tubes resulting from yarn packages that have been formed with either a so-called filling wind or a combination wind and, further, that the stripping station can be adapted alternatively for dealing effectively with spent spinning tubes that carry larger than usual quantities of residual yarn and require special handling for stripping renewal.

These and other features of the disclosed stripping means are described in further detail below in connection with the accompanying drawings identified by the listing that follows.

Description of the Drawings

FIG. 11 is a side view corresponding to FIG. 10;

FIG. 12 is a plan view corresponding to FIG. 11;

DETAILED DESCRIPTION OF THE INVENTION

Figure 1:
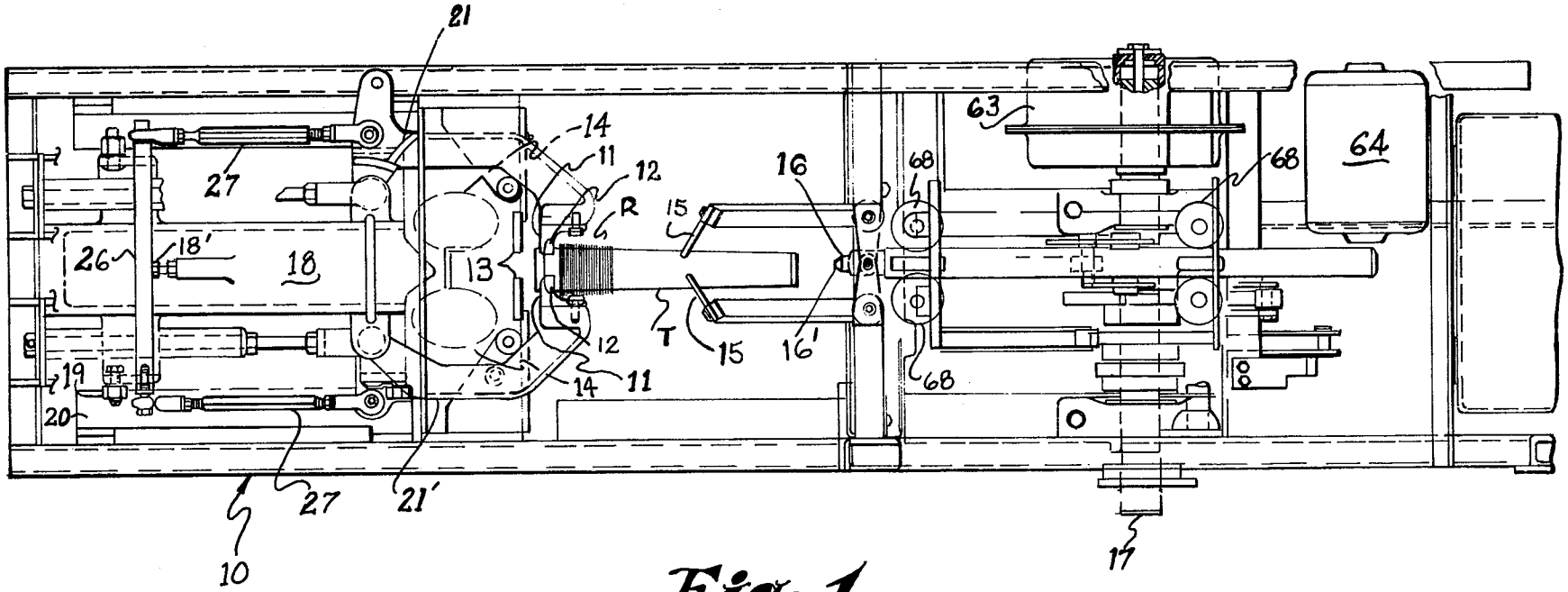
FIG. 1 is a plan view generally illustrating the overall arrangement of a stripping means embodying the present invention.
Figure 2:
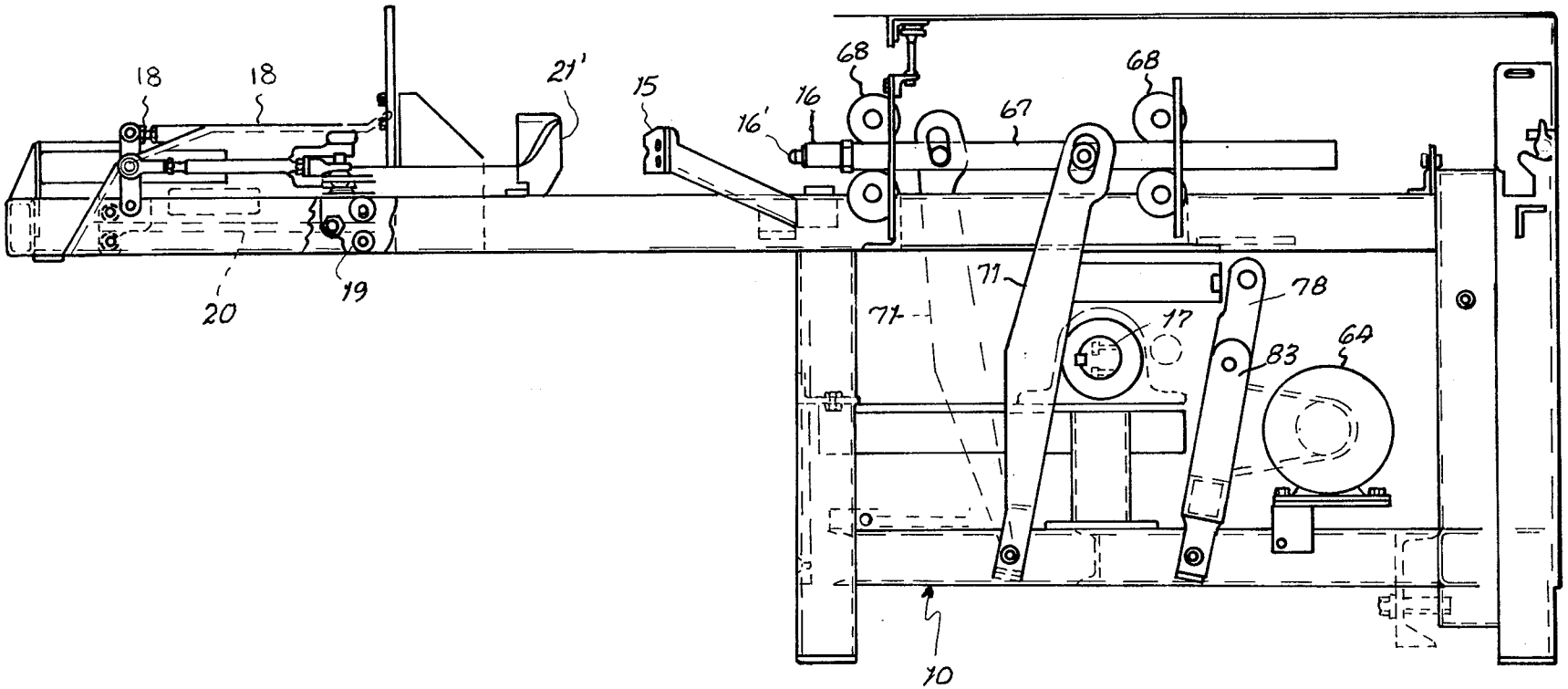
FIG. 2 is a side view corresponding to FIG. 1.

The general illustration of stripping means embodying the present invention that is provided by FIGS. 1 and 2 of the drawings indicates a spent spinning tube T carrying residual yarn R aligned in position for stripping. The components employed for performing the stripping are arranged on a suitable frame structure, designated generally by the reference numeral 10, and include a pair of mounting brackets 11 on which stripping blades 12 are fitted; a following pair of wiper elements 13 which extend from fixed mountings so that the adjacent edges thereof are spaced to provide a gap therebetween narrower than the spinning tube diameter to insure that stripped residual yarn R is fully removed from the spinning tubes T and allowed to drop downwardly therefrom for collection in a waste bin (not shown) positioned below; and a final pair of extractor rolls 14 that receive the stripped tubes T and project them into a separate recovery bin (not shown) where they accumulate as a renewed supply ready for reuse.

The spent spinning tubes T are aligned successively for stripping by means operating in relation to a feed structure that is not illustrated in FIGS. 1 and 2 but is shown in other drawings that are described in particular detail further below. Upon alignment the spent tubes T are supported and held in this position by concurrent application thereto of stripping blades 12 adjacent the tube base and of paired guide plates 15 at an intermediate tube body portion. Stripping of the aligned spinning tube T then proceeds by extension of a reciprocating plunger member 16 having a tube contacting end formed with an extending nose portion 16' shaped to enter the tip end of aligned tube T and shouldered at the base of this nose portion for bearing axially at the full circumference of the tube tip end face to press the aligned tube T axially through the stripping blades 12.

Figure 3:
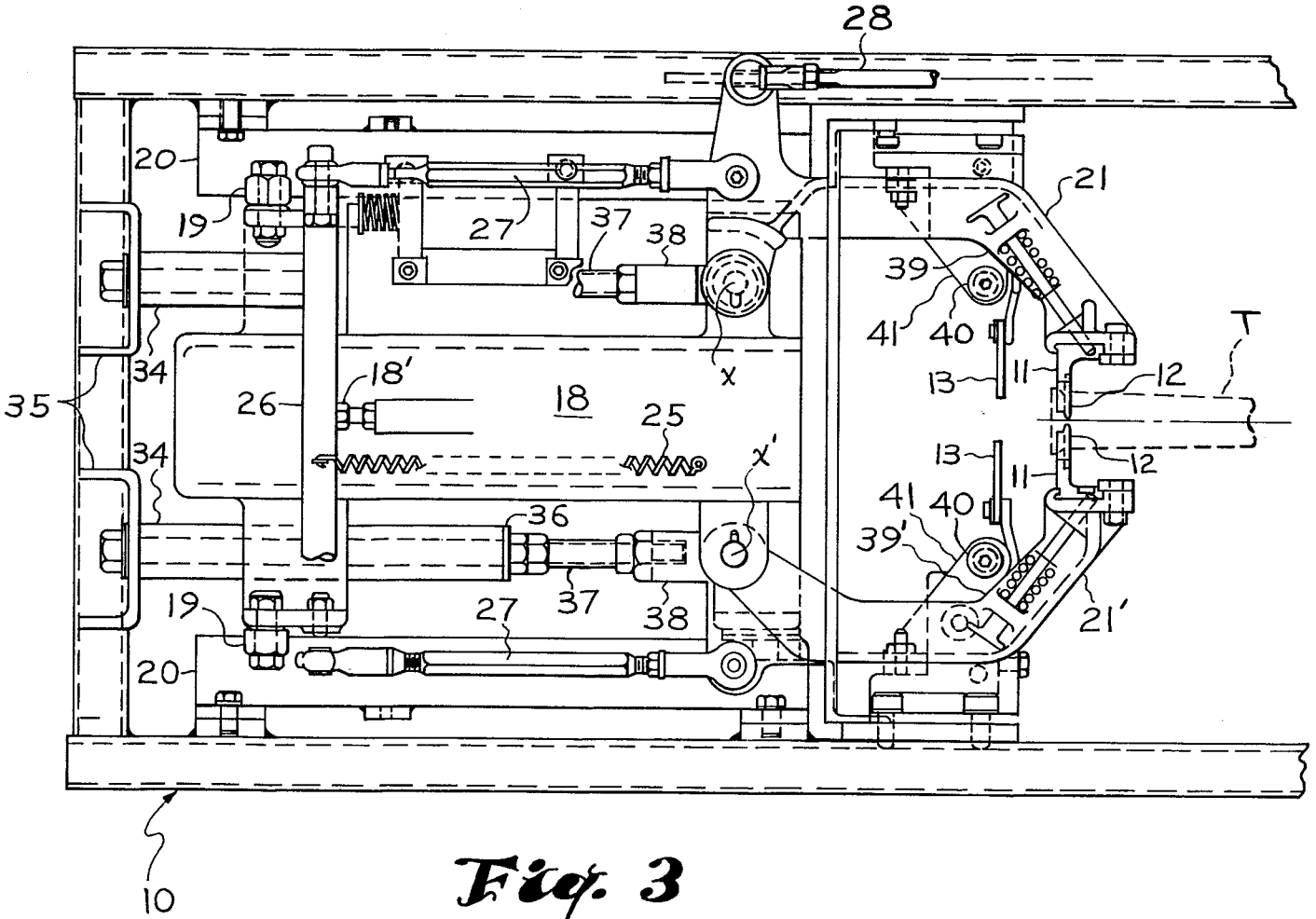
FIG. 3 is an enlarged plan view of the stripping section of the FIG. 1 arrangement.
Figures 4, 5, 6, 7, 8, 9:
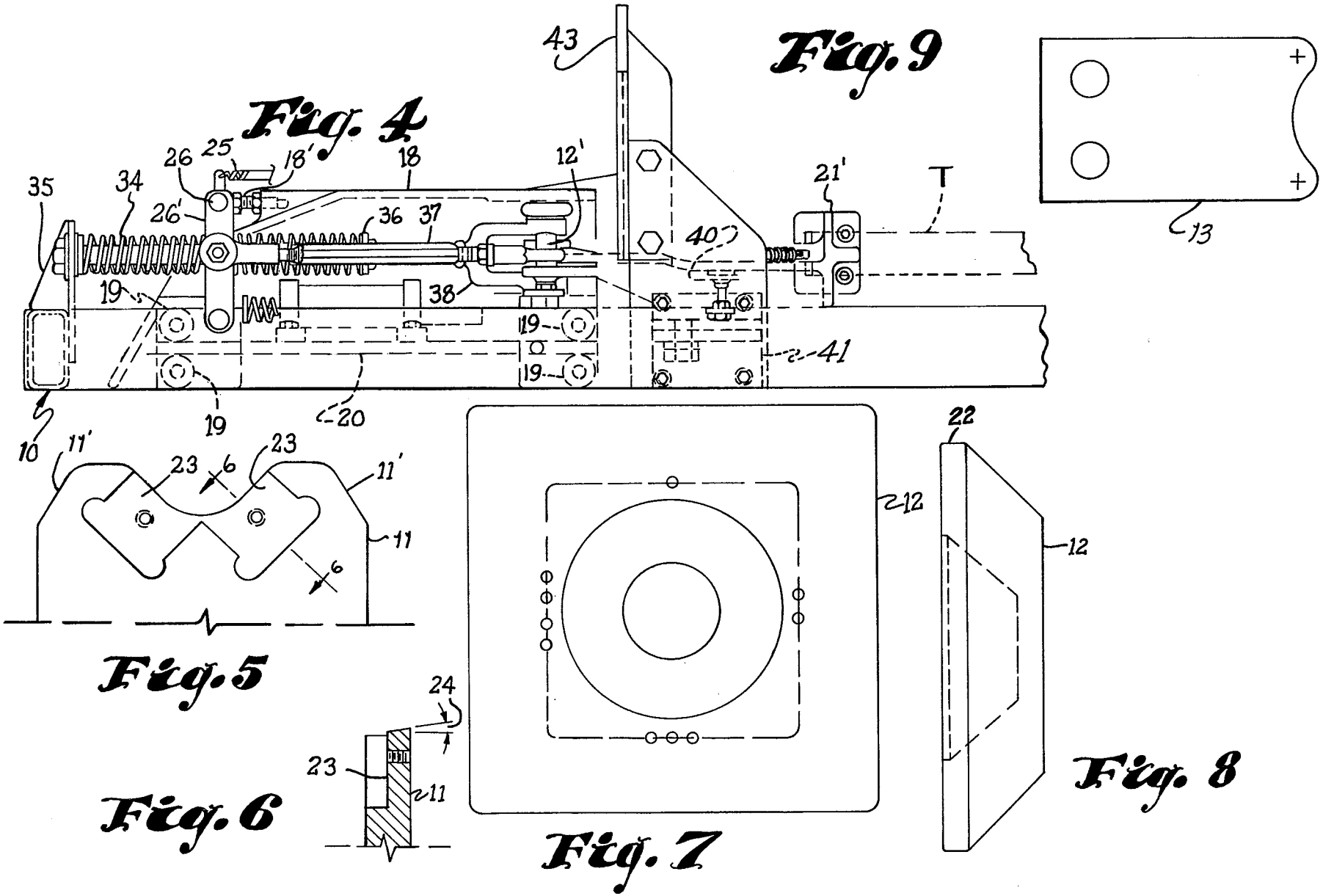
FIG. 4 is a side view corresponding to FIG. 3.
FIG. 5 is a fragmentary side view of the mounting bracket for the stripping blades.
FIG. 6 is a section detail taken substantially at the line 6—6 in FIG. 5.
FIG. 7 is a plan view of the stripping blades employed according to the present invention.
FIG. 8 is a side view corresponding to FIG. 7.
FIG. 9 is a plan view of the wiper blades shown in FIG. 3.
Figure 10:
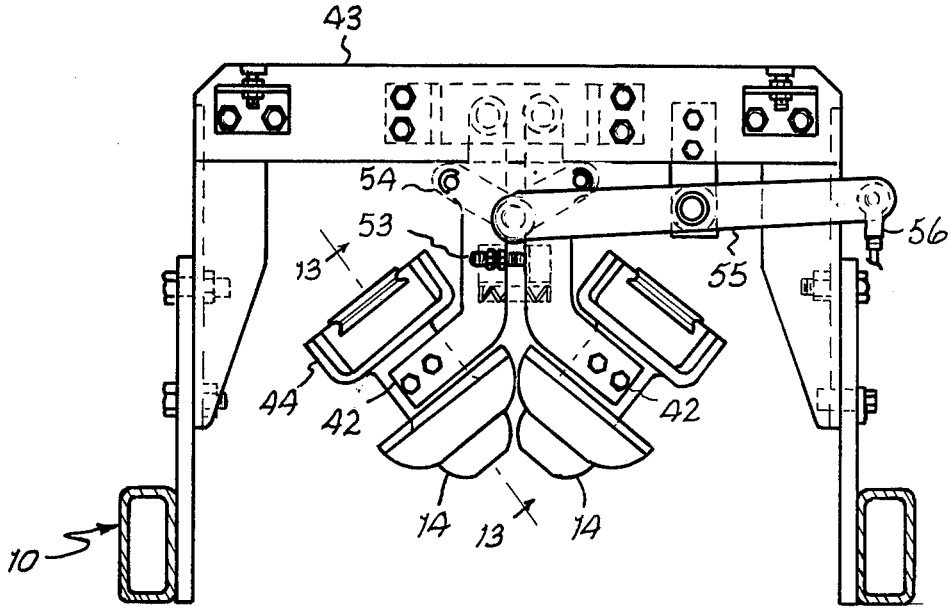
FIG. 10 is a detail of the assembly arrangement for the extractor rolls employed according to the present invention.
Figure 13:
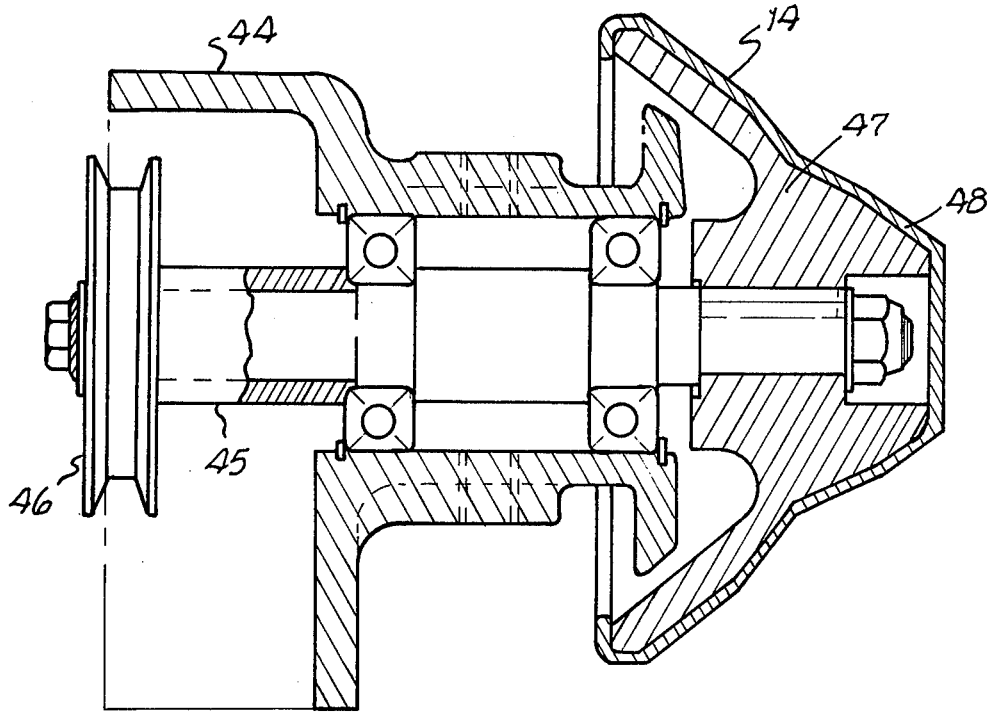
FIG. 13 is a section detail taken substantially at the line 13—13 in FIG. 10.

Reciprocation of plunger member 16 is actuated from a camshaft 17, as are all of the related motions for the various components of the stripping means, which are noted in detail further below. FIGS. 3 and 4 indicate the arrangement of the stripping blade section of the equipment at an enlarged scale. As indicated in FIGS. 3 and 4 the stripping blade arrangement comprises a carriage structure 18 mounted on front and back roller pairs 19 for shifting on frame-mounted rail plates 20 parallel to the axis of an aligned spinning tube T. Respective arm members 21 and 21' are pivoted on carriage 18 at fixed points X and X' spaced transversely thereon in excess of the diametric size of the tube T to be stripped and are arranged at their extending ends for carrying the stripping blades 12. For the latter indicated purpose the extending ends of arms 21 and 21' are formed to receive the base portions of the stripping blade mounting brackets 11 in vertically oriented undercut groove arrangements, while spring-biased latching plungers are carried on arms 21 and 21' to extend into the grooved spaces and engage related openings in the mounting bracket base portions so as normally hold them in place but to remain retractable for releasing the mounting brackets 11 readily whenever they need to be removed for repositioning or replacement of the stripping blades 12.

The stripping blades 12, as detailed particularly in FIGS. 7 and 8, comprise plastic elements, preferably acetal resin mouldings, having working surfaces formed by edges 22 of these elements. The blade mounting brackets 11, which are shown fragmentarily in FIGS. 5 and 6, have angled positioning recesses 23 formed therein to receive the blade elements 12 and arrange two of these elements in a projecting V-shaped configuration for stripping application to the spinning tubes T by each mounting bracket 11. Such arrangement of the blade elements 12 allows them to act effectively over a range of spinning tube diameters and always provides a 4-point contouring fit along the taper of the tubes being stripped. The blade elements 12 are advantageously square in form so as to present usable working surfaces 22 at each square edge and are apertured centrally for securing, by suitable screws or the like, in the angled mounting bracket positioning recesses 23, while the recesses 23 are angled at 45° so that the projecting working edges 22 of blade elements 12 are positioned in 90° relation to form the previously noted V-shaped configuration. The plastic blade elements 12 provide highly effective stripping action because their working edges 22 are self-sharpening to a valuable degree as they wear in the course of use, so as to maintain a quite consistent capability for biting into the residual yarn R to produce a tenacious stripping grip thereat. Also, the square shape and mounting arrangement of the blade elements 12 allows them to be repositioned in the mounting bracket recesses 23 to present all four sides successively as fresh working edges 22 as wear in use requires. In this connection it is additionally notable that the edge portions of the mounting brackets 11 at the open ends of the positioning recesses 23 therein are formed at a negative angle, as indicated at 24 in FIG. 6, directed oppositely to the direction of spinning tube movement during stripping so that any exposure of the recess edge portions 24 due to wear of the plastic blade element 12 installed thereat and failure to renew the worn blade edge 22 by repositioning or replacement of element 12 will result in preventing effective stripping until the worn blade edge condition is corrected.

Application of the stripping blade elements 12 to a spent spinning tube T for stripping is effected by a tension spring 25 (see FIG. 3) anchored at one end on carriage 18 and extending therefrom to a torsion bar 26 that reaches between pivot legs 26' from which tie rods 27 are connected to the stripping blade pivot arms 21 and 21' so that spring 25 biases them to close the blades 12 on an interposed spinning tube T. Adjustable bolt 18' is mounted on carriage 18 to limit the forward movement of torsion bar 26 and thereby set the closing extent of stripping blades 12. Withdrawal or opening of the stripping blades 12 is actuated through a push rod 28 that engages a transversely projecting portion of pivot arm 21 and is operated from a camshaft 17 by a follower arm 29 (see FIG. 20) that is mounted on a rock shaft 30 which also carries a rock arm 31 to which push rod 28 is connected and at which connection a tension spring 31' (see FIG. 19) extends oppositely to an anchor point (not shown) at an adjacent portion of frame 10 to bias follower arm 29 for maintaining it always in active position. The same follower arm 29 also serves to operate the guide plates 15 from camshaft 17, as additionally shown in FIG. 20, through rock shaft 30, an additional rock arm 32 thereon, and a connecting rod 33 running to a pivot arm assembly 33' through which opening and closing of guide plates 15 is actuated. Follower arm 29 is arranged to operate at cam 61 (shown in FIG. 20) and acts to time the previously mentioned concurrent closing of stripping blades 12 and guide plates 15 for supporting a spent spinning tube T in aligned position for stripping when it has been transferred to this position from the feed supply.

When closing of stripping blades 12 occurs by reason of the foregoing operating arrangement, carriage 18 is biased by springs 34 (compare FIGS. 3 and 4) for positioning so that the stripping blades 12 are caused to close on an aligned spinning tube T adjacent the base thereof. For this purpose springs 34 are contained between bottoming brackets 35 on frame 10 and nutpositioned washers 36 on elongated bolts 37 that extend through bracket 35 and co-axially through springs 34 to penetrate clevis elements 38 that are mounted in pushing relation at the axes X and X' for pivot arms 21 and 21'. The initial closing of stripping blades 12 on an aligned spinning tube T presented for stripping is limited in case no tube T is present by the adjustable bolt 18' to close only far enough to well engage the small end of a tube T, and is biased to bear at a relatively low pressure on the base tube barrel portion that is ordinarily exposed adjacent the tube base, and this circumstance together with the plastic nature of the blades 12 significantly minimizes any tendency toward scuffing of the tube barrels during stripping. As stripping proceeds upon extension of plunger 16 to press the aligned spinning tube T between the blades 12, the residual yarn R to be stripped is brought into contact with blades 12 which bite into this yarn R and the geometric arrangement of the supporting pivot arms 21 and 21' results in a wedging tendency that builds up blade pressure sufficiently to keep blades 12 engaged with the residual yarn R for stripping purposes, while the engaged yarn being stripped continues to protect the spinning tube barrel against scuffing.

In the event that the particular residual yarn R being stripped proves to be lodged to an unreasonably stubborn degree on the spinning tube T so that pressing action of the plunger 16 is resisted by a required stripping force sufficiently high to threaten damage to the spinning tube being stripped, the stripping blade application is relieved through reaction against the bias of springs 34 with a resulting retraction of carriage 18 which has the effect of bringing edge portions 39 and 39' of pivot arms 21 and 21' that slope outwardly from the mountings of blades 12 into contact with adjacently positioned camming rolls 40 carried by bracket structures 41 mounted on frame 10 so that pivot arms 21 and 21' are spread enough to relieve the blade pressure and reduce the resisting stripping force to a tolerable level. Whereupon the plunger 16 completes its extension stroke to press the spinning tube T involved through the relieved blades 12 which will probably pass the involved tube T incompletely stripped, but are pretty certain to have dislodged the stubborn residual yarn R enough so that it is apt to strip quite readily when presented again for stripping, while having preserved the spinning tube T in sound shape for reuse in the course of handling it.

Figure 34:
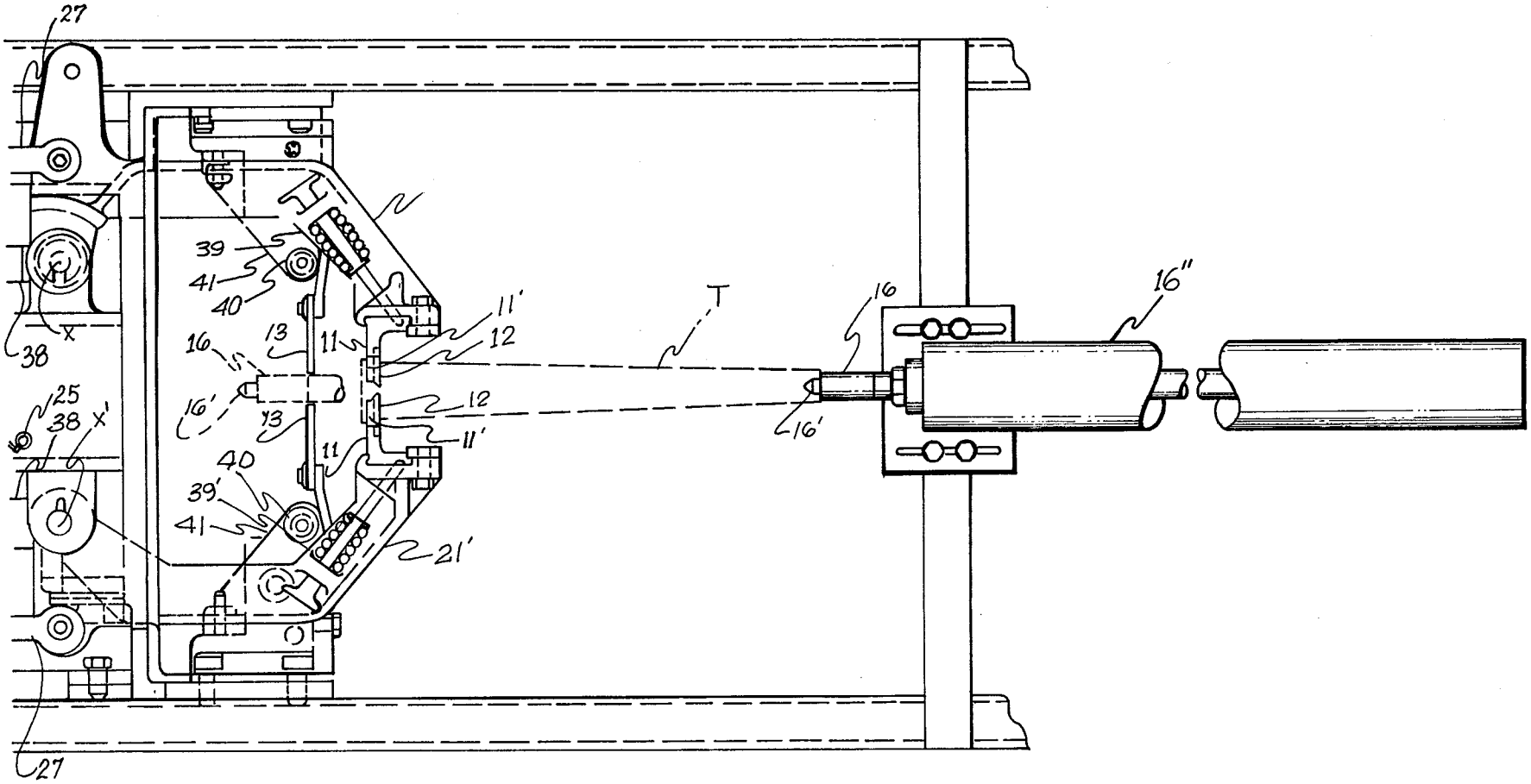
FIG. 34 is a view comparable to FIG. 3 showing a modified form of the apparatus.

The wiper elements 13 that follow stripping blades 12 to insure full removal of stripped residual yarn R from the spinning tubes T are suitably shaped as is shown in FIG. 9 and are serviceably formed of 85–90 durometer polyurethane rubber. The foregoing arrangement of the stripping blades 12, together with the wiper elements 13, is additionally useful, as noted earlier, for "big piece" stripping comparable to that disclosed in U.S. Pat. No. 2,907,091, where the residual yarn R to be stripped remains in a considerably larger amount than is usual. For such a purpose, the stripping blade arrangement and wiper elements would be provided in the form already described but combined with a fixed aligning support for the spinning tubes T (as shown in FIG. 34) formed by the plunger nose portion 16' at which the top ends of the tubes T would be manually placed while their base ends would be pressed downwardly at inclined edges 11' of mounting brackets 11 to separate the stripping blades 12 to locate them manually in aligned position for stripping and the plunger 16 would then be powered by an air cylinder 16 and having a stroke sufficient to push the tubes T all the way through the stripping blades 12 and wiper elements 13. With an arrangement of this sort, the previously mentioned cam shaft 17, and all its associated working parts, including the afore-mentioned push rod 28 for opening the blades 12, may be omitted, while the stripping blades 12 upon spreading to relieve the stripping force encountered initially in dealing with the "big piece" to be stripped would still maintain contact with the residual yarn R over its entire length as the tubes T are pushed therethrough so as to loosen the yarn R and tend to "shell-off" part of it toward the small tube end, then as the incompletely stripped tube T is rerun through the arrangement this process will be repeated until the "big piece" size has been reduced sufficiently to allow some subsequent rerun to strip it off normally. Such stripping is greatly preferable to the commonly employed expedient of cutting the "big piece" residual yarn R off by hand both because it is more rapid and safer, and because it consistently avoids any spinning tube damage that would prevent reuse.

An arrangement of this sort for alternative "big piece" use would not require a final pair of extractor rolls 14 such as are employed for fully automating the stripping means shown in the drawings. FIGS. 10 through 14 show the particular form and operating arrangement of these rolls 14 which are hung on pivot arms 42 from a bridging bracket structure 43. The extending ends of pivot arms 42 are attached to spindle housings 44 in which spindles 45 are journalled to carry the extractor rolls 14 at one end and drive pulleys 46 therefor at the other end (compare FIGS. 10 and 13). Each of the extractor rolls 14 includes a rigid roll base 47 that is mounted directly on the spindle 45 and a roll cover 48 assembled on the base 47, the cover 48 is preferably formed of polyvinyl chloride having a hardness in the order of 55 durometer (Shore A) for gripping the stripped spinning tubes T without marring them. The roll base 47 and the cover 48 assembled therewith are shaped from an extending end portion with a configuration of increasing diameter that is circumferentially indented intermediate of the axial roll length, and are mounted in complementary relation on inclined axes in a plane transverse to the axis of a spinning tube T aligned for stripping and with the intermediate indentation aligned with the spinning tube axis so as to receive the base end of a spinning tube T that has been pressed axially between the stripping blades 12 for gripping and extracting the same after stripping.

The spindle pulleys 46 are engaged by drive belts 49 which reach from a shaft 50 connected through a belt drive 51 with an operating motor 52 to provide for rotation of rolls 14 (see FIGS. 11 and 12). The pivot arms 42 carrying rolls 14 are fitted with an adjustable stop screw 53 for limiting their adjacent spacing, and with toggle links 54 operated by a fulcrummed lever 55 from which a connecting link 56 extends to a pivot plate 57 at which an actuating rod 58 is arranged to reach therefrom to one arm of a bellcrank 59 that has its other arm biased by a spring 60 in following relation at cam 61 carried by camshaft 17 (compare FIGS. 10 and 14). Cam 61 is suitably shaped and timed (not shown) to act through this arrangement for spreading the pivot arm 42 and thereby moving the extractor rolls 14 apart for receiving the base end portion of a spinning tube T fully therebetween beyond stripping blades 12 and wiper elements 13, and then for allowing biased closing of pivot arms 42 to cause the extractor rolls 14 to grip a spinning tube base end portion that has been received after blades 12 have reopened.

Figure 15:
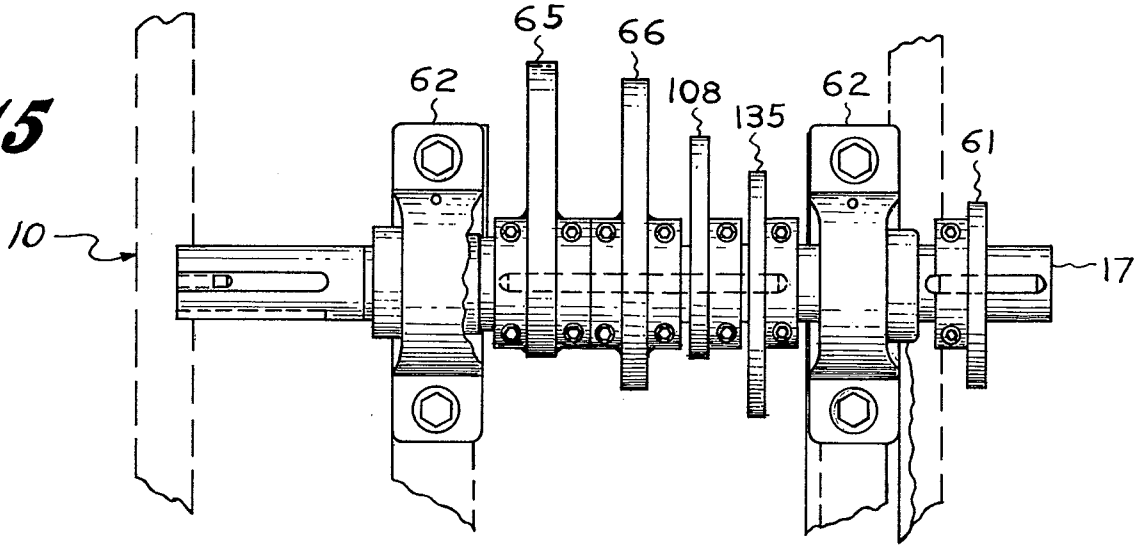
FIG. 15 is a plan view of the camshaft assembly for the stripping means shown in FIGS. 1 and 2.
Figure 14:
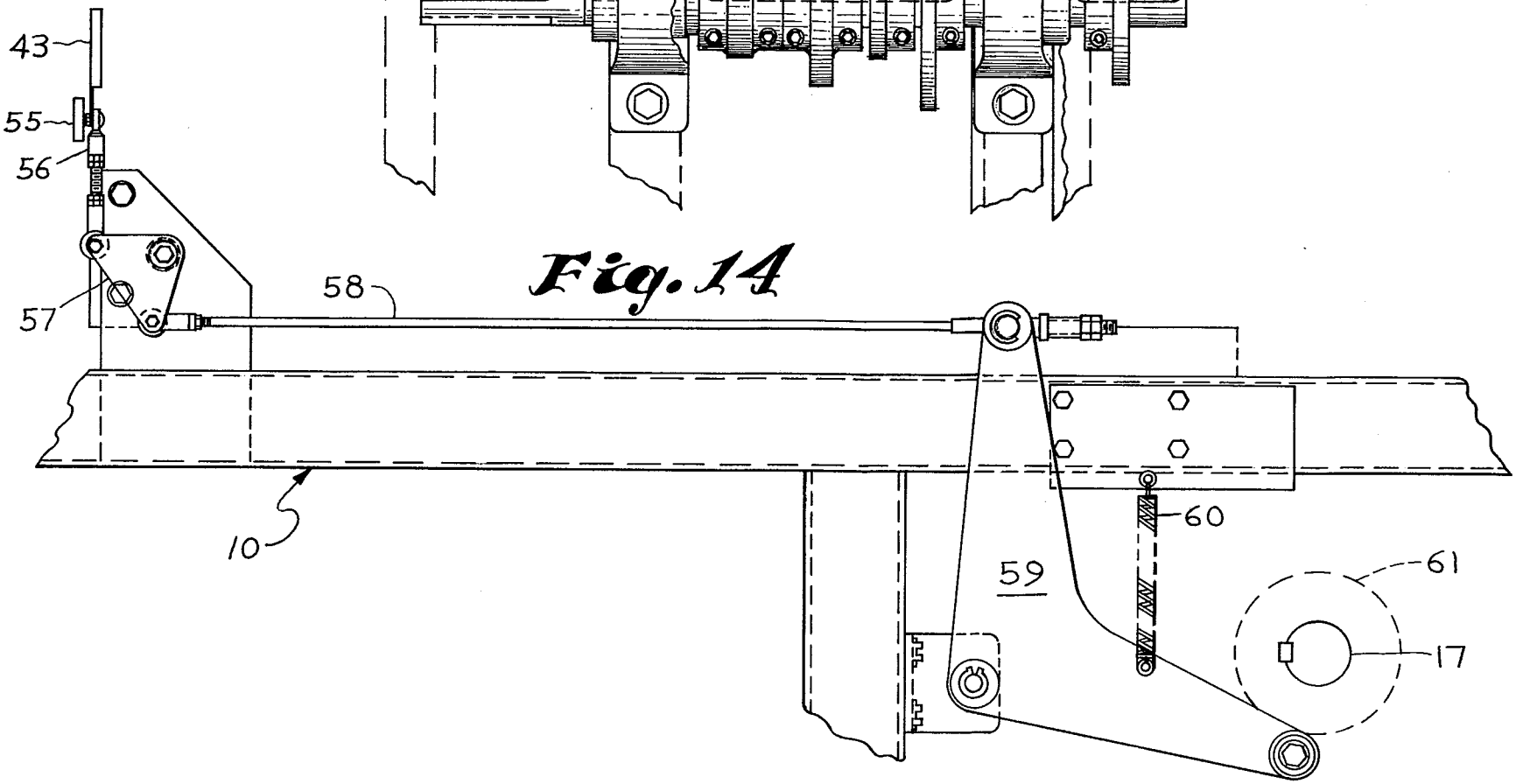
FIG. 14 is a side view of the positioning linkage for the FIG. 10 extractor rolls.
Figure 16:
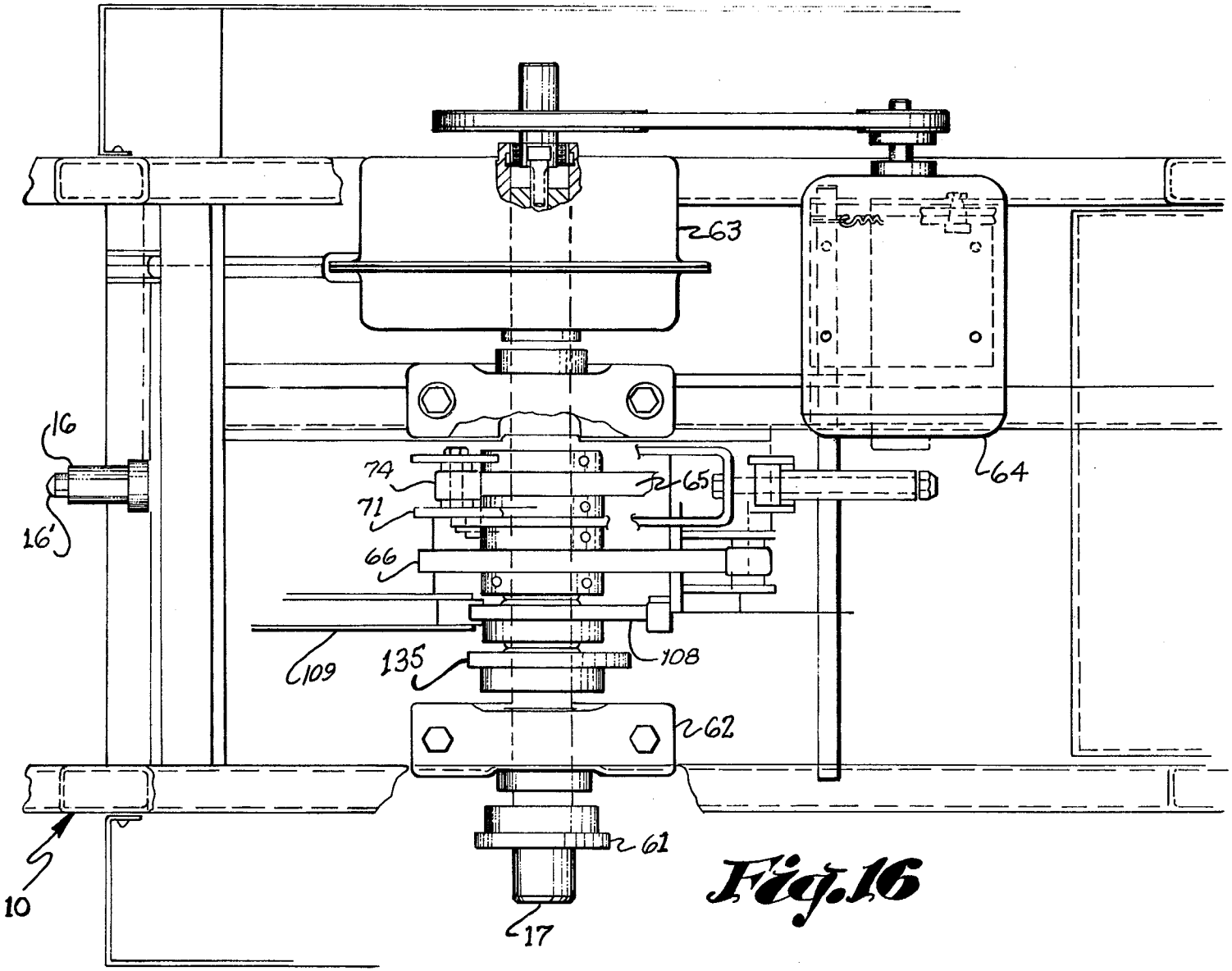
FIG. 16 is a plan view of the camshaft drive assembly.
Figure 18:
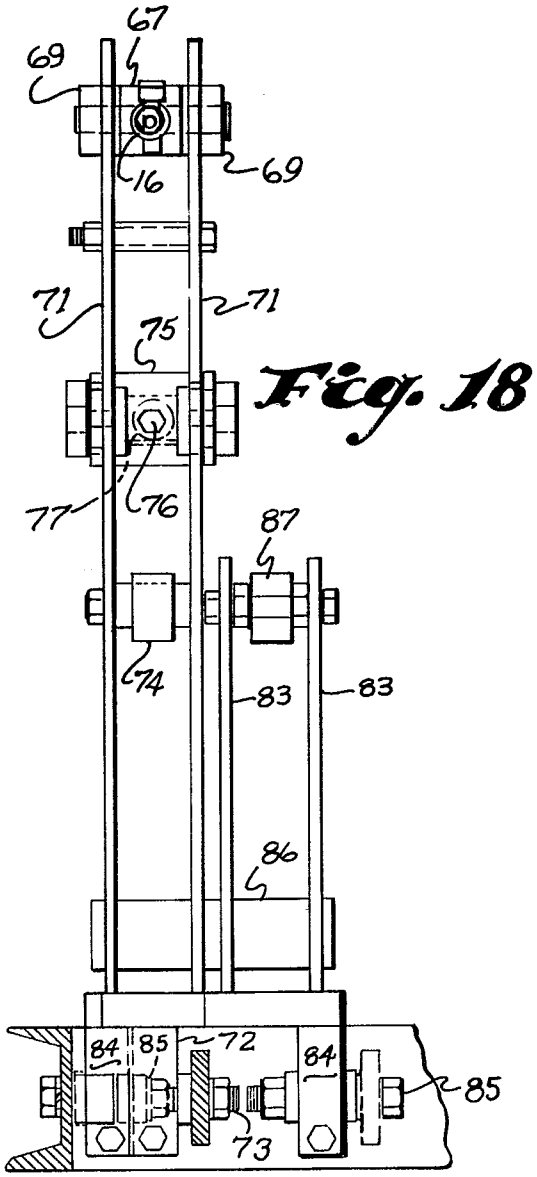
FIG. 18 is a left end view corresponding to FIG. 17.
Figure 17:
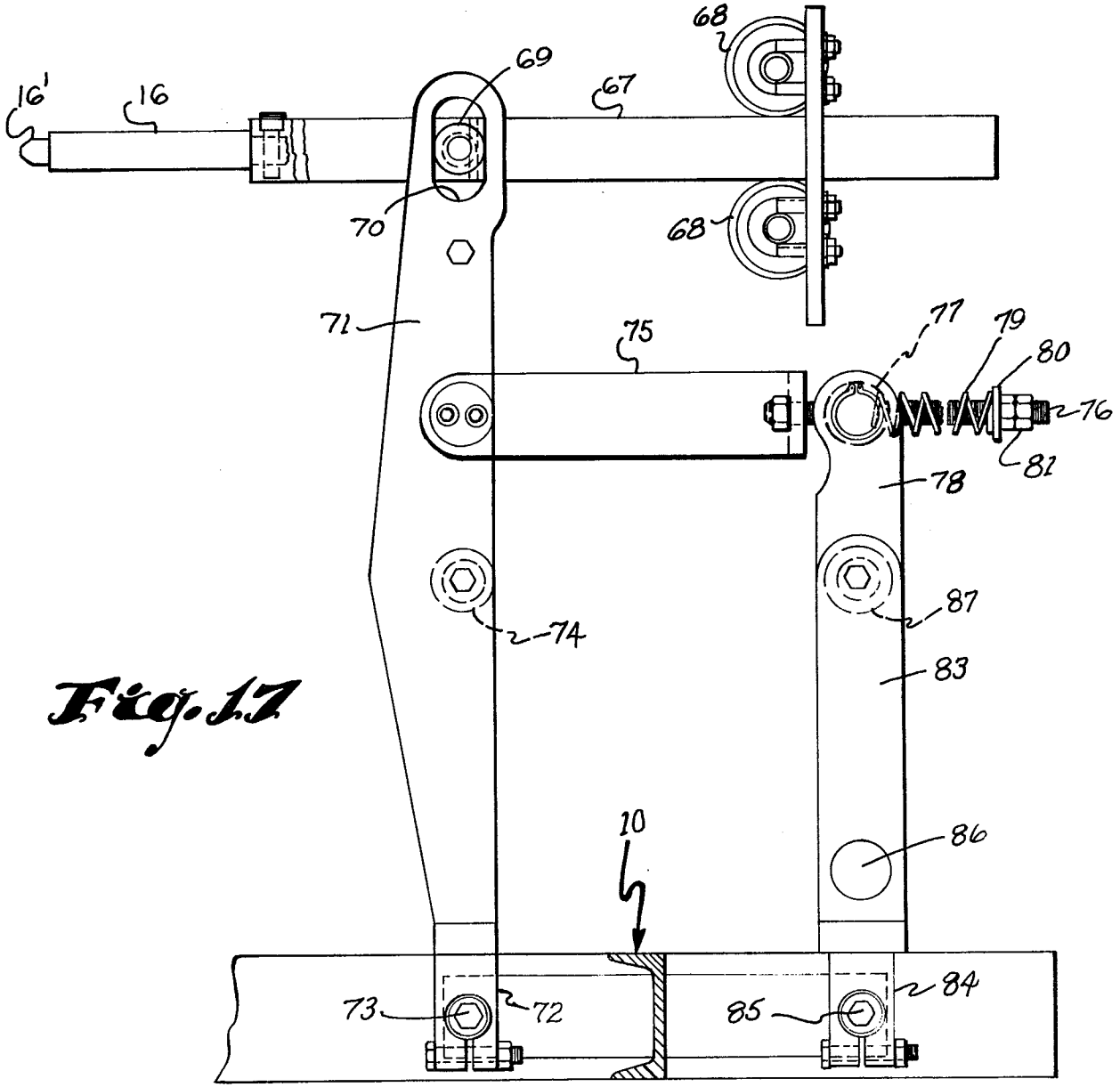
FIG. 17 is a side view of the plunger assembly for the stripping means shown in FIGS. 1 and 2.

The camshaft 17 from which the several operating motions of the presently described stripping means are actuated is shown in FIGS. 15 and 16 as being supported on frame 10 in pillow blocks 62 and driven through a gearbox 63 from a motor 64. FIG. 16 also fragmentarily indicates the plunger operating motion which is actuated from cams 65 and 66, and which is shown best in FIGS. 17 and 18. The plunger 16 is provided as a head member having a shank that is fitted in and bolted to a rod member 67 that is of square cross section and that rides for reciprocation on spaced clusters of four rolls 68 forming positioning guides at each rod member 67 side (compare FIGS. 1, 2 and 17). A pair of follower rolls 69 are mounted at opposite sides of rod member 67 intermediate its length for operation in elongated slots 70 at the upper ends of paired forward levers 71 that are mounted at their lower ends on a clamp block 72 carried by a pivot bolt bearing means 73 on frame 10. The paired levers 72 are also fitted with a follower roll 74 that rides cam 65 for actuating the extension stroke of plunger 16, and with a pivoted yoke member 75 from which a threaded rod 76 extends rearwardly through a shaft member 77 fitted for rotation at the upper ends of a first pair of rearward levers 78 and beyond which threaded rod 76 carries a spring 79 that is confined by a washer 80 and lock nuts 81 at the free end of rod 76. A second pair of somewhat shorter rearward levers 83 are commonly mounted to operate in phase with the first pair 78 on a lower end base that includes spaced clamp blocks 84 arranged on pivot stud bearing means 85 on frame 10. An aligning shaft 86 extends through both the first and second lever pairs 78 and 83 to maintain and strengthen their in phase relation, and the second lever pair 83 carries a further follower roll 87 at its upper end which rides cam 66 to actuate the return stroke of plunger 16 in a manner that eliminates any backlash and maintains a smoothly reciprocating plunger motion.

Figure 35:
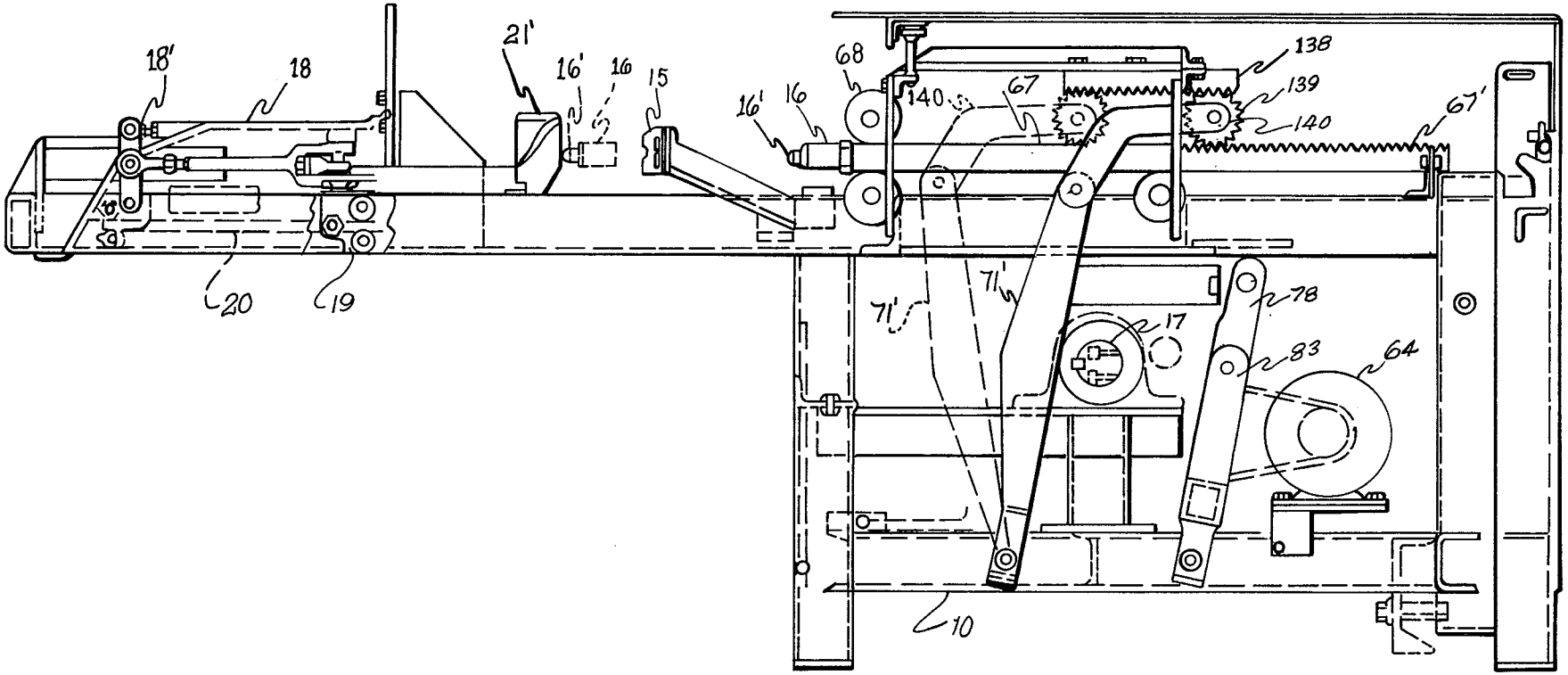
FIG. 35 is a view comparable to FIG. 2 showing a further modified form of the apparatus.

The plunger arrangement just described is suited for stripping spinning tubes T on which the residual yarn R is left from an original yarn package built with a so-called "filling wind", as is usually the case. It is necessary, however, to deal at times with spinning tubes T on which a "combination wind" was employed in forming the original package, and when this is the case the residual yarn R left will require substantially doubling the plunger stroke for stripping. To obtain such stroke doubling, without doubling the actuating cam throw, a rack and pinion multiple can be added for this purpose. Such an addition (see FIG. 35) would simply involve mounting a fixed rack 138 above and parallel to the plunger body member 67, while cutting a cooperating rack 67' in an adjacent portion of member 67 and interposing a pinion 139 between the fixed and plunger racks having a drag link 140 fitted thereto for movement by a lever 71' arranged for operation from the actuating cams to provide the longer reciprocating stroke required.

Figure 19:
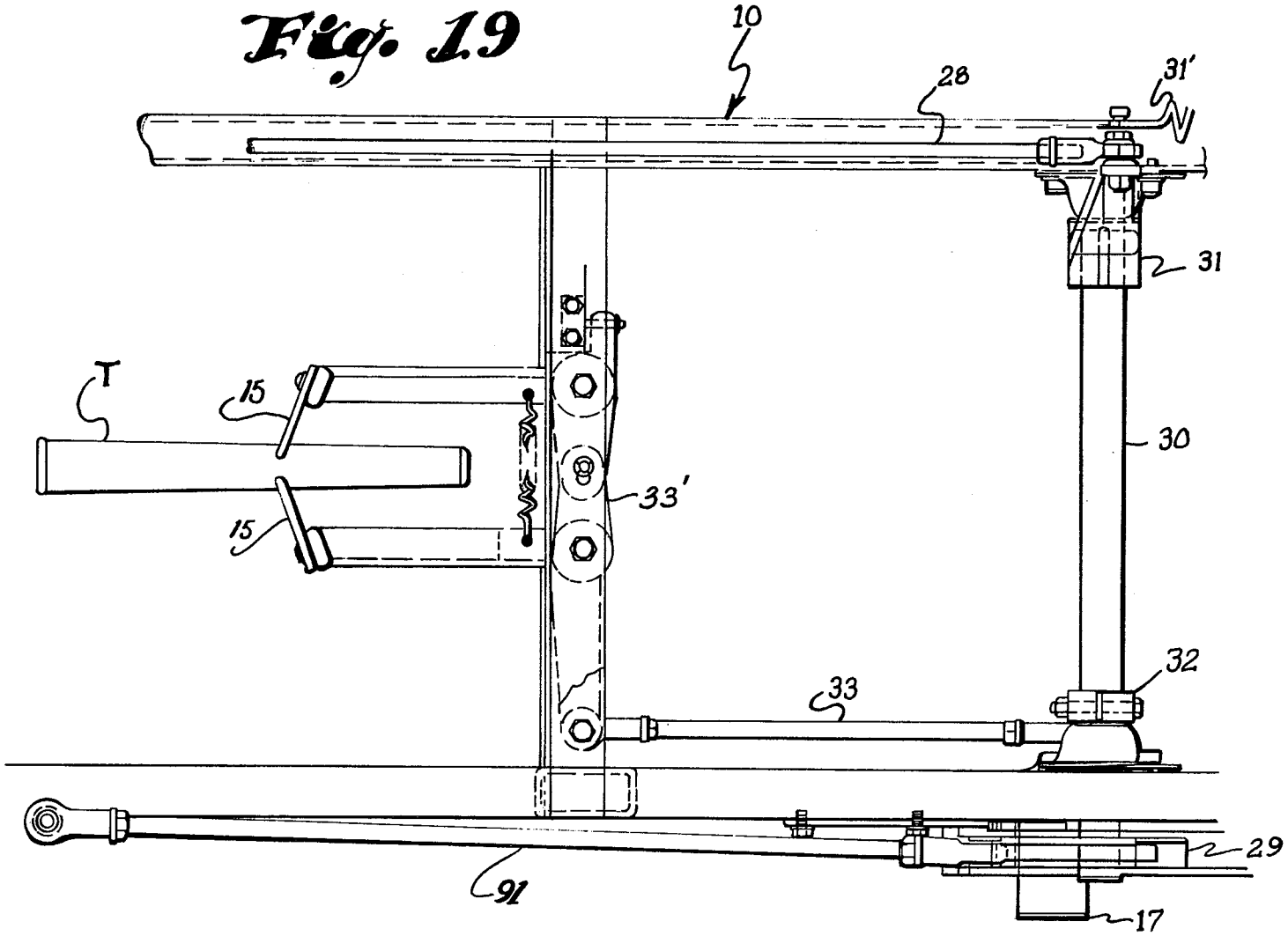
FIG. 19 is a plan view showing the positioning linkage for the guide arms employed to align a spinning tube initially for stripping.
Figure 20:
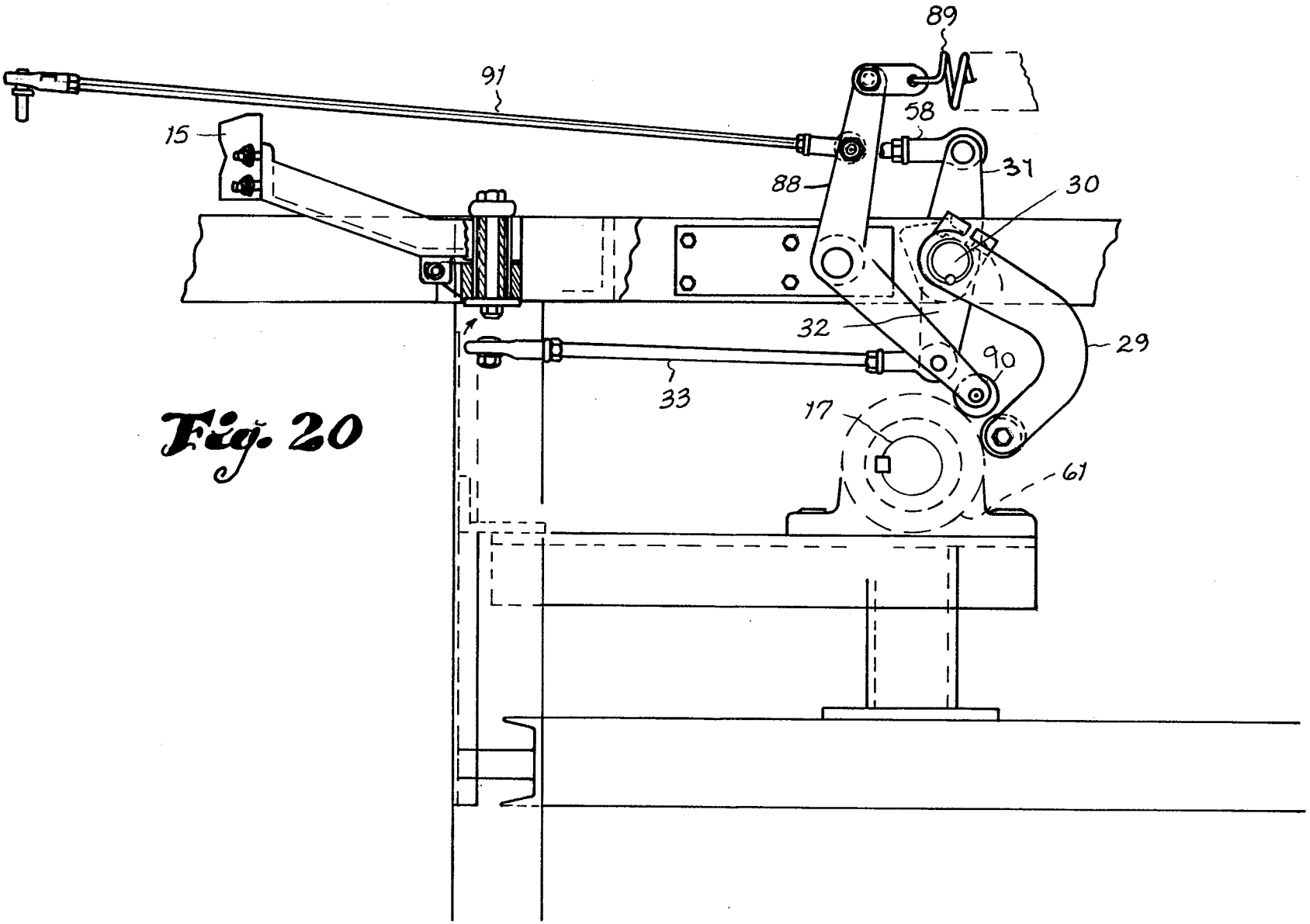
FIG. 20 is a side view corresponding to FIG. 19.
Figures 21, 22:
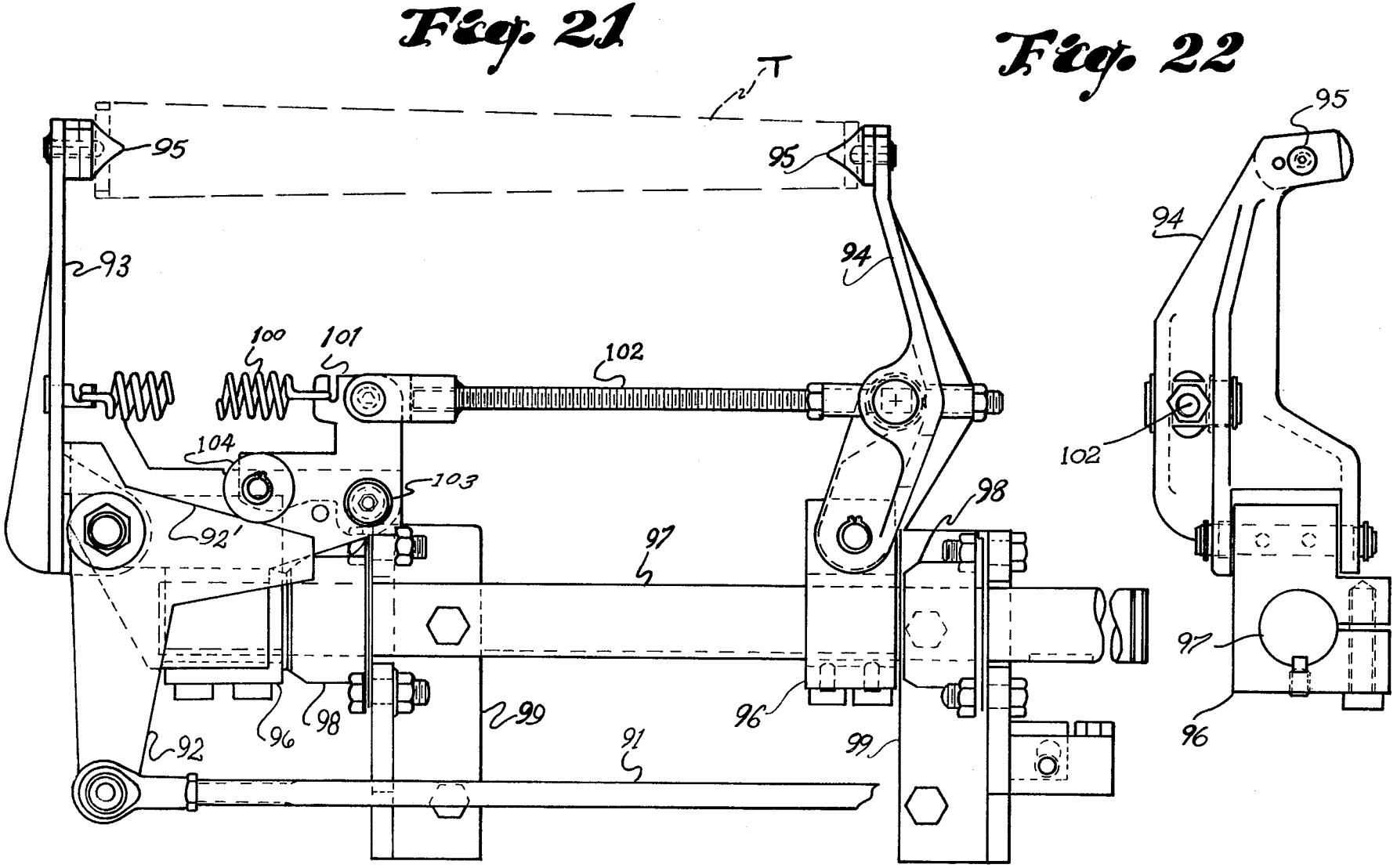
FIG. 21 is a side view of the transfer assembly by which the spinning tubes are moved to alignment for stripping.
FIG. 22 is a right end view corresponding to FIG. 21.

The remaining operating motions actuated from camshaft 17 are concerned with the means provided for transferring a spent spinning tube T from a feed supply to an aligned position for stripping, and for this purpose the first actuating linkage involved (as seen in FIGS. 19 and 20) includes a bell-crank 88 having one arm biased by a spring 89 to maintain a follower roll 90 carried by the other arm in riding contact at cam 61, while the biased bellcrank arm also has a pull rod 91 extending therefrom which is seen in FIG. 21 connected to a pivot arm member 92 with which a first transfer arm 93 is assembled. This first transfer arm 93 is paired in opposing relation with a second transfer arm 94 both of which have elements 95 at their extending end for respectively engaging the base and tip ends of a spinning tube T and holding the same aligned therebetween, and both transfer arms 93 and 94 are pivotally arranged on clamp blocks 96 that are mounted on a rock shaft 97 carried in bearings 98 supported on brackets 99 that are provided on the machine frame (not shown), the mounting arrangement being such as to allow rocking of transfer arms 93 and 94 transversely with respect to the axis on which spinning tube T is to be aligned for stripping. Additionally, the transfer arms 93 and 94 are connected by a linkage that includes a spring 100 attached to arm 93, a cam following member 101 to which spring 100 is also attached, and a push rod 102 pivotally extending from member 101 and pivotally connected with the other transfer arm 94. The cam following member 101 is fitted with a guide roll 103 positioned to ride the top edge of the adjacent bearing bracket 99 and with a follower roll 104 arranged to ride a cam arm portion 92' of the pivot arm assembled with the first transfer arm 93. Accordingly, whenever cam 61 at camshaft 17 allows the following bias on bellcrank 88 thereat to exert a pulling force on pull rod 91 the pivot arm 92 is caused to react against the bias of spring 100 in the connecting linkage between transfer arms 93 and 94 so as to spread them apart sufficiently to accept a spinning tube T between the tip elements 95 thereof in position for closing thereon when cam 61 reverses the pulling motion of pull rod 91.

Figure 23:
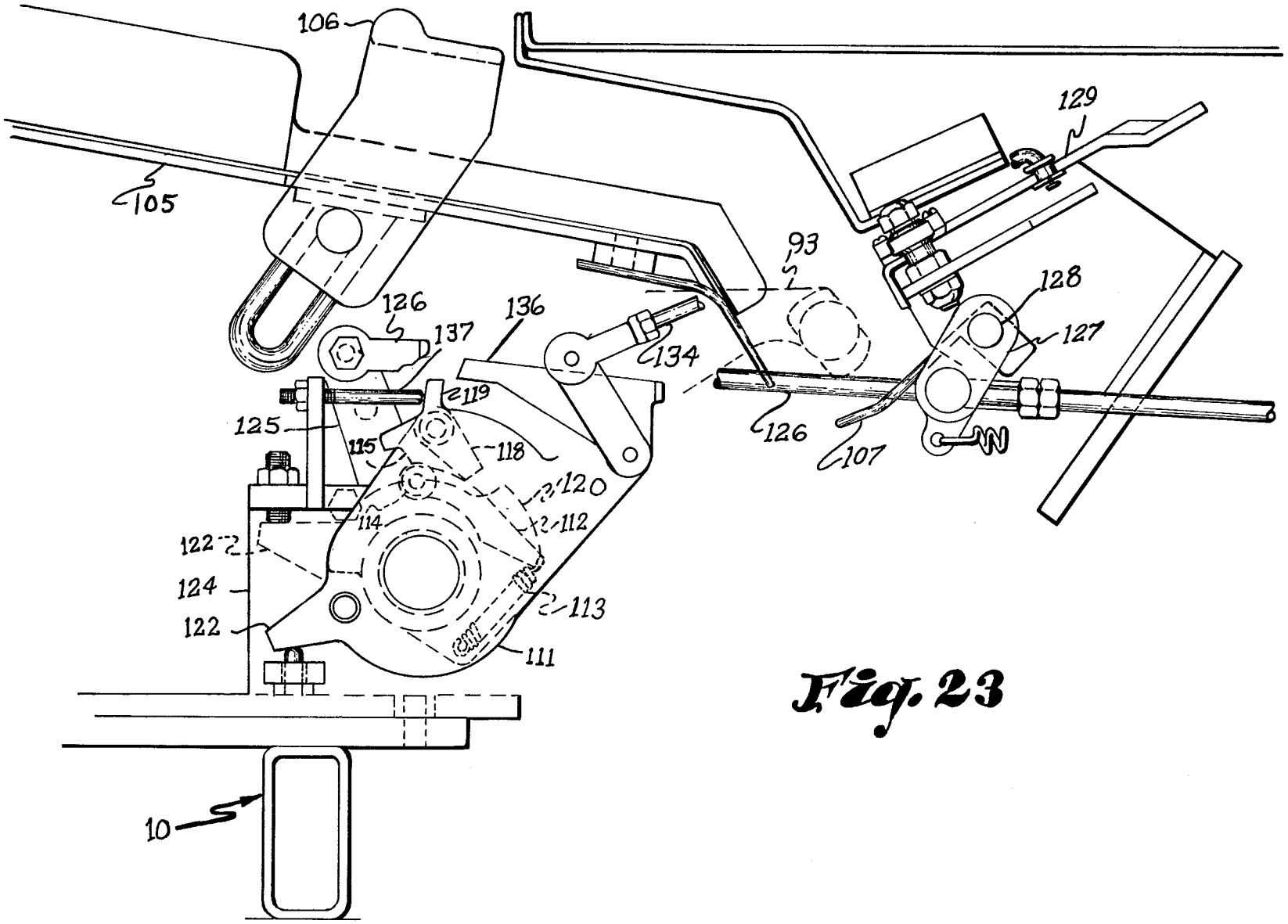
FIG. 23 is a layout indicating the arrangement of the feed station at which spent spinning tubes are supplied for stripping together with the means by which the spinning tubes are transferred to an aligned position in proceeding with the stripping operation.
Figure 25:
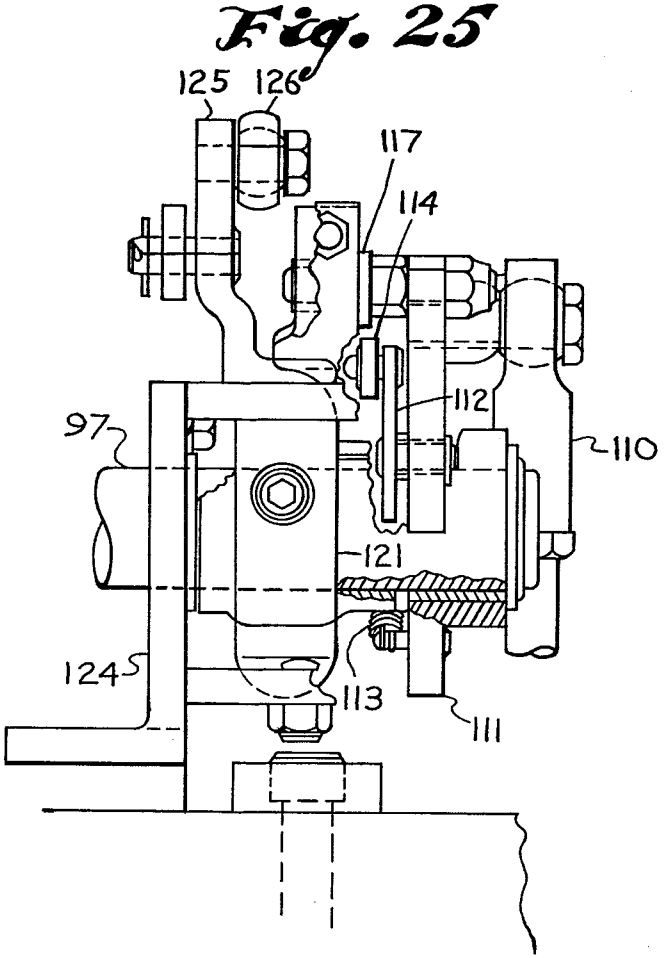
FIG. 25 is a left end view corresponding to FIG. 24.
Figure 24:
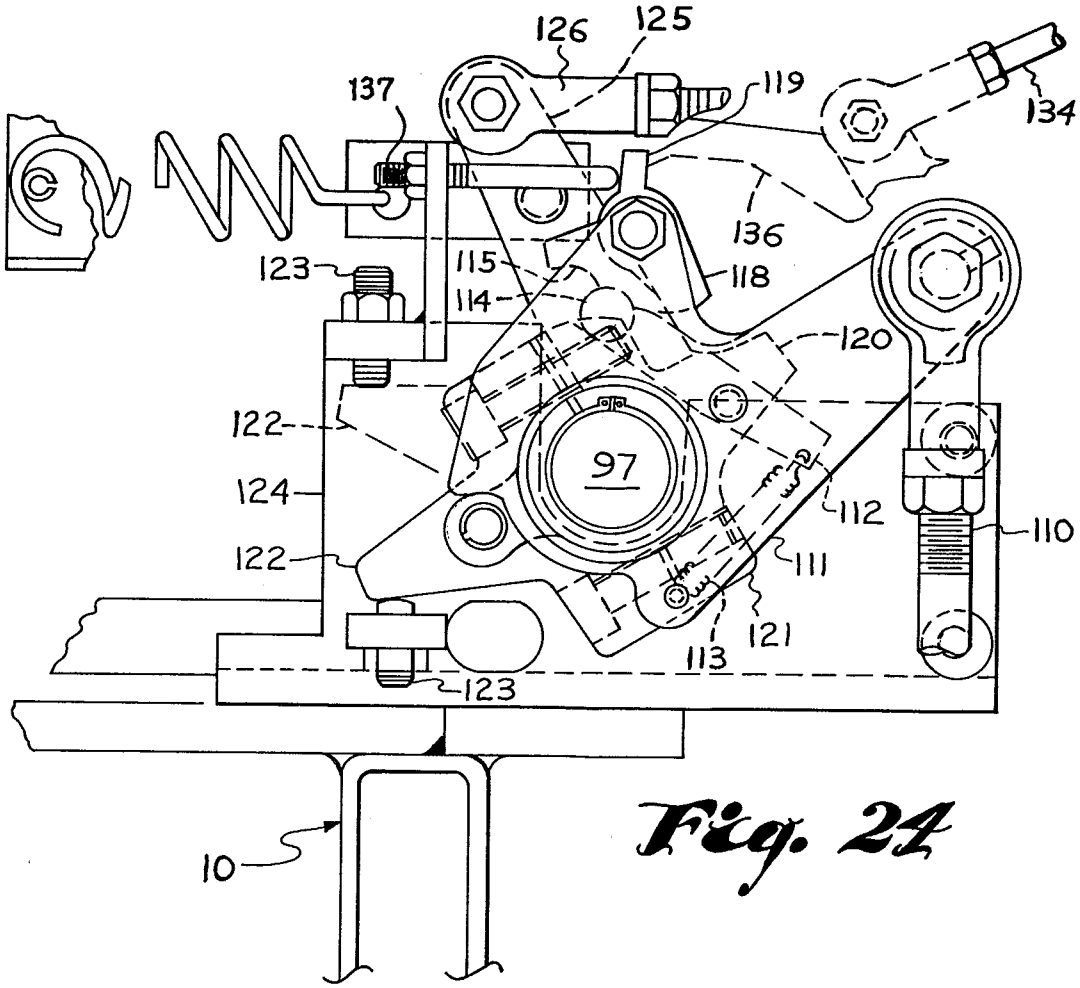
FIG. 24 is a side view detailing means provided for preventing operation of the transfer assembly whenever a supplied spent spinning tube is found to be out of position for proper transfer.
Figure 26:
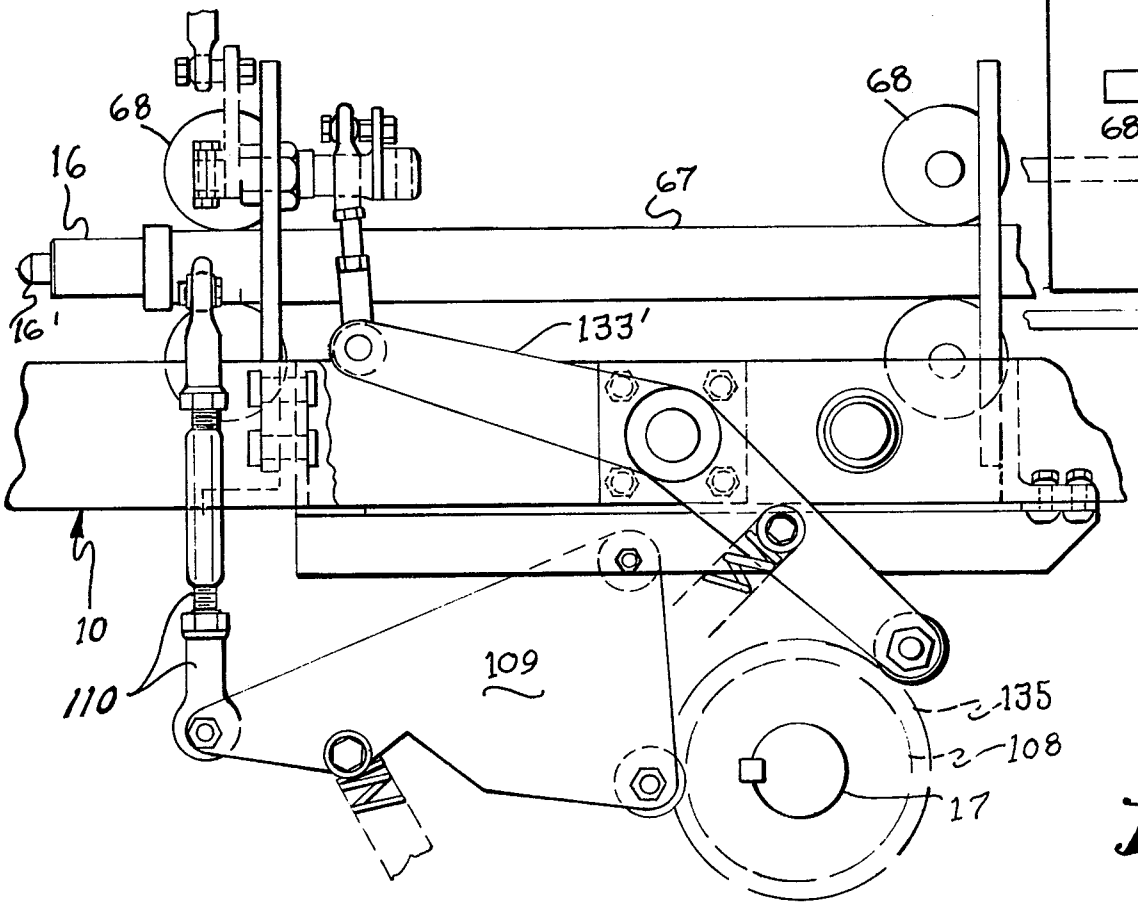
FIG. 26 is a side view showing the actuating linkage for the transfer motion of the FIG. 21 means and the related means for preventing such motion when necessary as noted in connection with FIG. 23.

FIG. 23 indicates the related arrangement of a feed chute 105 from which a feed supply of spent spinning tubes T is delivered for successive engagement and handling by transfer arms 93 and 94. The chute 105 is fitted at each side with adjustable gaging brackets 106 that may be set to block feeding of any spinning tube T bearing too large a remainder of residual yarn R for stripping in regular course, but is otherwise arranged for serial advance of the spinning tube feed supply by gravity to a trap door 107 at which the leading spinning tube T is supported for engagement by the tip elements 95 of transfer arms 93 and 94. When such engagement is accomplished a further operating motion is brought into play that causes downward pivoting of transfer arms 93 and 94 to align the engaged spinning tube T at the axis of plunger 16. The operating motion for this purpose is actuated from camshaft 17 by cam 108 through a biased pivot plate 109 carried on frame 10 and having a pull link 110 extending therefrom (as seen in FIG. 26) for connection with a locator assembly (as seen in FIGS. 24 and 25) which is carried on the transfer arm rock shaft 97 at the portion thereof shown extending to the right in FIG. 21.

The locator assembly (see FIGS. 24 and 25) has a lever plate 111 having an extending arm portion at which pull link 110 is connected. Lever plate 111 also has a hub portion at which it is mounted freely for rotation on the transfer arm rock shaft 97, and carries a pivoted positioning lever 112 that is biased at one end by spring 113 and is fitted at its other end with a positioning roll 114 suited for lodging in either of two notches 115 formed at the edge of a wing portion 116 of a flip-flop member 117 (see FIGS. 32 and 33) that is also pivotally carried on lever plate 111. Flip-flop member 117 additionally includes a finger portion 118 and an ear portion 119 extending in angled relation thereto. The finger portion 118 normally hangs at a downwardly inclined position where it is held by the lodging of positioning lever roll 14 in the right hand wing portion notch 115, as seen in FIG. 24. At this position finger portion 118 is disposed for abutting contact at a nose portion 120 of a two-part transfer motion locator 121 that is assembled on transfer arm rock shaft 97 and keyed thereto. Locator 121 also has a lug portion 122 projecting therefrom for swinging between adjustable limit screws 123 arranged on a support bracket 124 mounted on frame 10, and a pivot arm portion 125 additionally projects from locator 121 for connection at its extending end with an operating rod 126 running to a pivot fitting 127 mounted on a rock shaft 128 carrying trap door 107. Accordingly, when pull link 110 is caused to move downwardly through following action at cam 108 the locator assembly lever plate 111 is rotated clockwise on transfer arm rock shaft 97 so as to carry flip-flop 117 downwardly with resulting abutment of the finger portion 118 thereof at the nose portion 120 of locator 121 that is in turn caused to rotate rock shaft 97 and pivot transfer arms 93 and 94 downwardly to align an engaged spinning tube T with plunger 16, whereupon the transfer arms 93 and 94 are opened in the manner described earlier to leave the aligned tube T supported by guide plates 15 and stripping blades 12 and allow transfer arms 93 and 94 to return to their initial position at feed chute 105. The extent of the pivoting transfer motion of arms 93 and 94 is regulated by the adjusted setting of limit screws 123, and the operating rod 126 acts to pivot trap door 107 out of the way as transfer arms 93 and 94 pivot downwardly and return.

Figure 27:
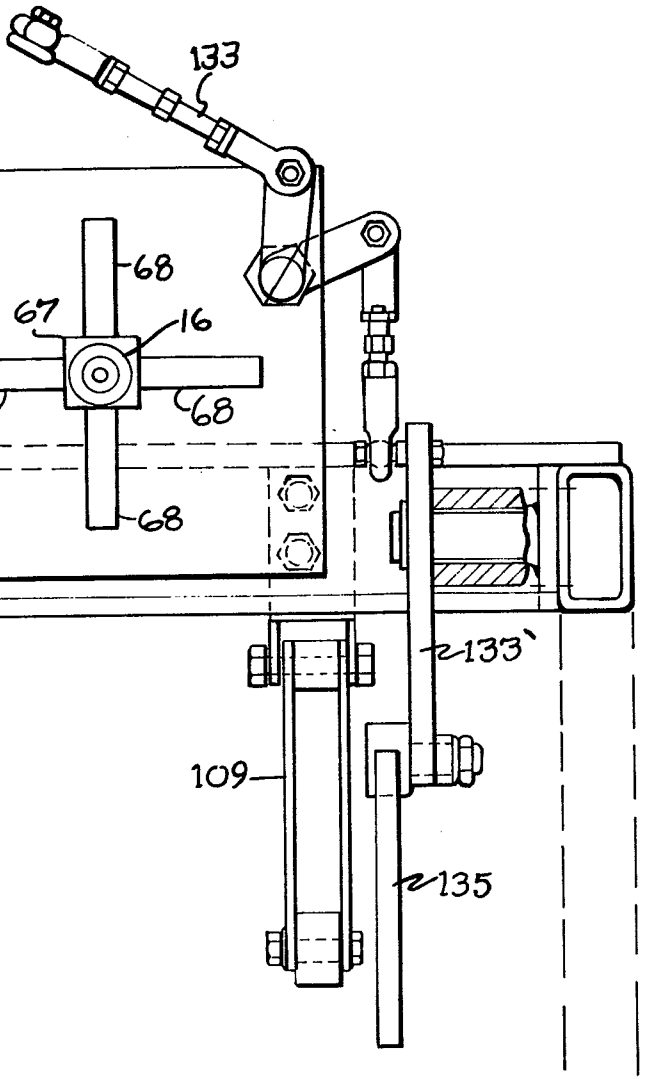
FIG. 27 is a left end view corresponding to FIG. 26.
Figures 28, 29, 30, 31, 32, 33:
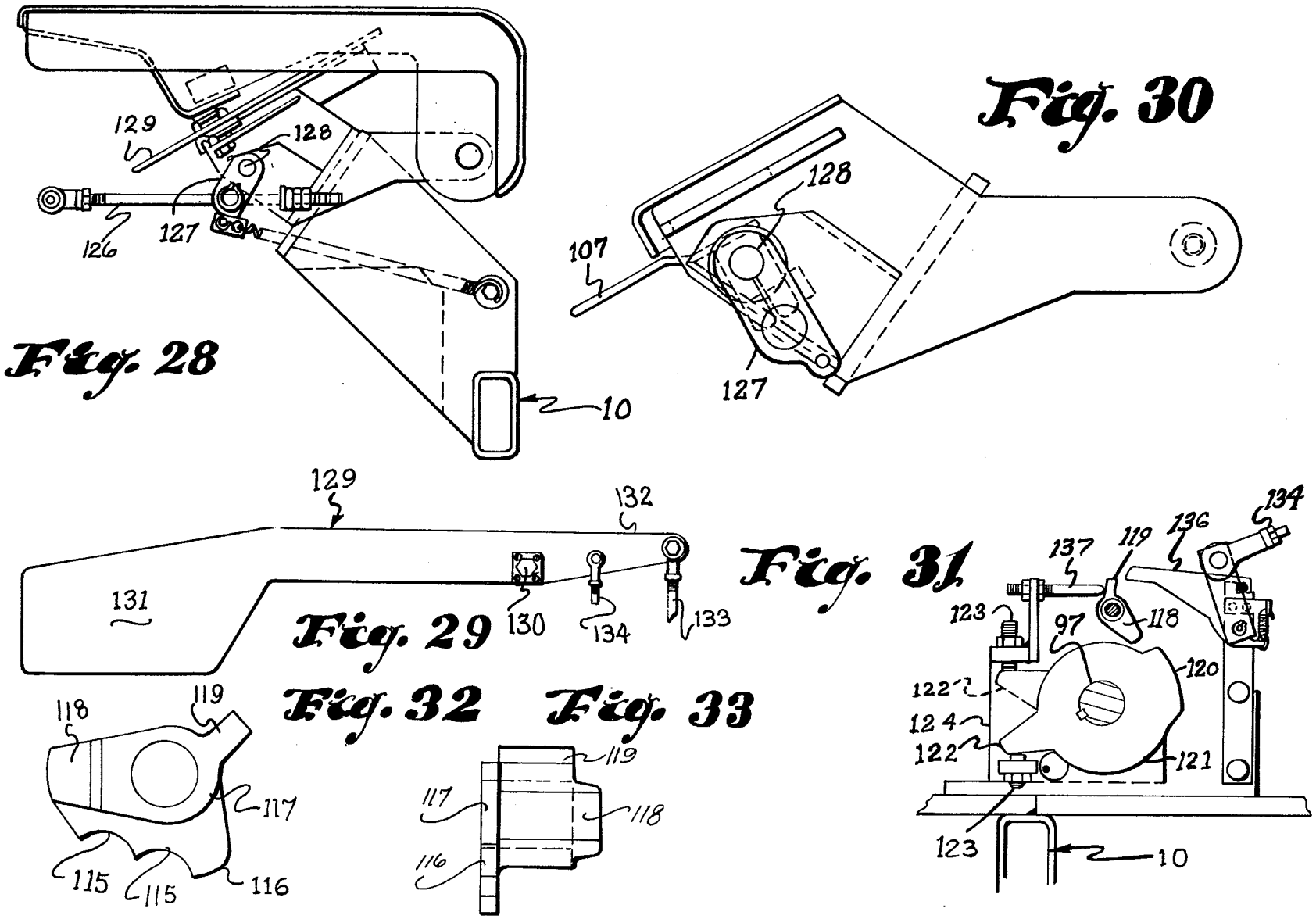
FIG. 28 is a side view further indicating the arrangement of the previously noted transfer preventing means.
FIG. 29 is a plan detail of the shutter element forming part of the FIG. 28 transfer preventing means.
FIG. 30 is a side detail of the trap door arrangement included in the FIG. 28 transfer preventing means.
FIG. 31 is a side detail indicating the arrangement of the trip finger through which the transfer preventing means becomes effective.
FIG. 32 is a plan detail of the flip-flop element at which the FIG. 31 trip finger operates.
FIG. 33 is a left side view corresponding to FIG. 32.

Finally, it is additionally notable, however, that on occasion a misfeeding of the spent spinning tubes T from the feed supply may occur through tangling of residual yarn R between tubes T or from misplacement for some reason so that the leading tube T will not come to rest properly at trap door 107 for aligned engagement by transfer arms 93 and 94, and to guard against such occasions a shutter member 129 is mounted adjacent the mouth of feed chute 105 to feel the spinning tube feeding condition and insure that a spinning tube T is separately and properly supported at trap door 107 before the transfer motion is allowed to operate. The arrangement of shutter member 129 is indicated in FIG. 23 and shown in further detail in FIGS. 28 and 29. As shown in FIG. 29, shutter member 129 is pivotally mounted at 130 and is shaped with a separating blade portion 131 extending to one side of this pivot 130, while a shorter arm portion 132 extends to the other side with two operating rods 133 and 134 connected thereat. The related linkage for operating rod 133 is shown in FIGS. 26 and 27 including suitable articulation extending thereto from one arm of a bellcrank 133' that is biased to follow cam 135 on camshaft 17 at its other end and that is timed so that the separating blade portion 131 of shutter member 129 is caused to move inward at the mouth of feed chute 105 before each transfer motion commences. If the spinning tubes T are being fed in order so that blade portion 131 can move fully inward to separate the leading one in proper position for the transfer operation, this operation proceeds in regular course as described earlier. But if full inward movement of the shutter member blade portion 131 is blocked by any irregular feeding condition of the spinning tubes T the other operating rod 134 extending from shutter member 129 fails to lift a pivoted trip finger 136 (see FIG. 31) clear of flip-flop ear portion 119, as it usually does, and the result of this failure is to shift flip-flop 117 so that its lefthand wing portion notch 115 (see FIG. 24) is engaged by the positioning roll 114 of lever 112 to elevate flip-flop finger portion 118 clear of locator nose portion 120 and thereby disable the transfer motion until the improper feeding condition is corrected and normal positioning of flip-flop 117 can be restored at the next cycle by a reset rod 137 and maintained clear of trip finger 136 by full inward motion of shutter member 129.

The present invention has been described in detail above for purposes of illustration only and is not intended to be limited by this description or otherwise to exclude any variation or equivalent arrangement that would be apparent from or reasonably suggested by the foregoing disclosure to the skill of the art.

We claim:

1. In apparatus for stripping residual yarn from spinning tubes, the combination of means for aligning a spinning tube axially for stripping, means for applying a pair of stripping blades oppositely and transversely to the body of an aligned spinning tube adjacent the base thereof, means acting at the tip of an aligned spinning tube for pressing the same axially between said applied stripping blades, means responsive to a stripping force resisting said pressing means, and means for causing said blades to spread for reducing said stripping force when said force is sufficient to threaten spinning tube damage.

2. In apparatus for stripping residual yarn from spinning tubes, the combination of means for aligning a spinning tube axially for stripping, means for applying a pair of stripping blades oppositely and transversely to the body of an aligned spinning tube adjacent the base thereof, means acting at the tip of an aligned spinning tube for pressing the same axially between said applied stripping blades, and means for relieving said stripping blade application whenever said pressing means is resisted by a stripping force sufficient to threaten spinning tube damage, wherein said aligning means includes a pair of pivot arms having elements at their extending ends shaped for respectively engaging at the tip and base ends of a spinning tube along the longitudinal axis of said tube for supporting the same, said pivot arms being mounted for pivoting transversely with respect to the spinning tube axis, and means for pivoting said pivot arms so as to transfer a spinning tube from a supply position to an aligned position for stripping.

3. In apparatus for stripping residual yarn from spinning tubes, the combination defined in claim 2 wherein shutter means is provided to allow separate positioning of only one spinning tube at a time at said supply position, and means actuated by said shutter means for disabling said pivot arms against pivoting whenever said shutter means is prevented from allowing such separate positioning of one spinning tube at said supply position.

4. In apparatus for stripping residual yarn from spinning tubes, the combination defined in claim 2 wherein said combination additionally includes means for applying a pair of guide plates to an intermediate body portion of an aligned spinning tube concurrently with application of said stripping blades, so as to hold said spinning tube aligned and allow said pivot arms to open and return to said supply position.

5. In apparatus for stripping residual yarn from spinning tubes, the combination defined in claim 1 wherein each of said stripping blades has working surfaces formed by edges of plastic elements arranged for application to the spinning tube body in a V-shaped configuration.

6. In apparatus for stripping residual yarn from spinning tubes, the combination defined in claim 5 wherein each of said stripping blades have two of said plastic elements mounted thereon with straight working surface edges of said elements projecting in 90° relation to form said V-shaped configuration.

7. In apparatus for stripping residual yarn from spinning tubes, the combination defined in claim 6 wherein said plastic elements are square with usable working surface edges at each square side, and the mounting of said square elements is centrally arranged so that they are shiftable to project the sides thereof successively for working surface use.

8. In apparatus for stripping residual yarn from spinning tubes, the combination defined in claim 6 wherein said stripping blade applying means on which said plastic elements are mounted is formed of metal and the portion of said applying means having said plastic elements mounted thereon is shaped with edges having a negative angle in the direction opposite to that of spinning tube movement during stripping, whereby any exposure of said applying means edges due to wear of said plastic elements and failure to renew the active working surface edges thereof by repositioning or replacement will result in preventing effective stripping until the worn plastic elements are repositioned or replaced.

9. In apparatus for stripping residual yarn from spinning tubes, the combination defined in claim 1 wherein said stripping blade applying means comprises a carriage mounted for shifting movement parallel to the axis of an aligned spinning tube, a pair of arm members pivoted at fixed points spaced transversely on said carriage in excess of the diametric size of the aligned spinning tube to be stripped and having said stripping blades mounted at the extending ends of said pivoted arm members, means biasing said carriage for shifting movement normally to position said stripping blades for application adjacent the base of a spinning tube aligned for stripping, means additionally carried by said carriage and connected with said pivoted arm members for equalizing application and withdrawal of said stripping blades, means biasing application of said stripping blades to an aligned spinning tube, and means for withdrawing said stripping blades against said application bias to allow alignment of a spinning tube thereat.

10. In apparatus for stripping residual yarn from spinning tubes, the combination defined in claim 9 wherein said means for pressing an aligned spinning tube axially between said applied stripping blades comprises a reciprocative plunger with which said spinning tube is aligned and the tube contacting end of which is formed with an extending nose portion shaped to enter the tip end of said tube and is shouldered at the base of said nose portion for bearing axially at the full circumference of the tip end face of said spinning tube upon reciprocation to press said tube through said stripping blades.

11. In apparatus for stripping residual yarn from spinning tubes, the combination defined in claim 10 wherein said pivoted arm members on which said stripping blades are mounted are formed with an adjacent portion presenting an inwardly directed edge sloping outwardly from said blade mountings and a pair of cam rolls is fixed in respective corresponding relation to the sloping edges of said pivoted arm members at an adjacent spacing therefrom when said carriage is shifted normally by the bias thereon, but said sloping edges being forced into contact with said cam rolls whenever reciprocation of said spinning tube pressing means toward said stripping blades is resisted sufficiently by applied stripping force to cause retraction of said carriage against the bias thereon to force said contact and thereby form said means for causing said blades to spread for reducing said stripping force.

12. In apparatus for stripping residual yarn from spinning tubes, the combination defined in claim 1 wherein said combination additionally includes a pair of wiper blades extending oppositely from fixed mountings transversely with respect to the axis of an aligned spinning tube and spaced in following relation beyond said stripping blades when the latter are applied, said wiper blades being yieldable and having extending edges that reach from said fixed mountings to space said edges so that the gap therebetween is narrower than the diameter of a spinning tube aligned for stripping.

13. In apparatus for stripping residual yarn from spinning tubes, the combination defined in claim 1 wherein said combination additionally includes a pair of extractor rolls each of which is shaped from respective extending ends thereof with a configuration of increasing diameter that is circumferentially indented intermediate of the axial roll length, said rolls being mounted for rotation on inclined axes that dispose said roll configurations in complementary relation in a plane transverse to the axis of a spinning tube aligned for stripping and being located in following relation with respect to said stripping blades with said intermediate indented portions aligned with the spinning tube axis so as to receive the base end of a spinning tube that has been pressed axially between said stripping blades for gripping and extracting the same after stripping.

14. In apparatus for stripping residual yarn from spinning tubes, the combination defined in claim 13 wherein the inclined mounting axes for said extractor rolls are respectively supported on pivot arms, means operable to spread said pivot arms and thereby move said extractor rolls apart for receiving the base end portion of a spinning tube freely therebetween beyond said stripping blades, and means biasing said pivot arms together for causing said extractor rolls to grip a spinning tube base end that has been received.

* * * * *